US005907343A

United States Patent [19]

Takemura et al.

[11] Patent Number: 5,907,343

[45] Date of Patent: May 25, 1999

[54] INK JET RECORDING APPARATUS AND CARTRIDGE FOR USE IN THE SAME

[75] Inventors: Makoto Takemura; Koji Terasawa; Takashi Nojima, all of Tokyo; Katsuyuki Yokoi, Yokohama, all of Japan

[73] Assignee: Canon Kabushiki Kaisha, Tokyo, Japan

[21] Appl. No.: 08/824,836

[22] Filed: Mar. 26, 1997

Related U.S. Application Data

[63] Continuation of application No. 08/367,764, Jan. 3, 1995, abandoned, which is a continuation of application No. 07/936,740, Aug. 31, 1992, abandoned, which is a continuation of application No. 07/574,084, Aug. 29, 1990, abandoned.

[30] Foreign Application Priority Data

| | | | |
|---|---|---|---|
| Aug. 29, 1989 | [JP] | Japan | 1-222601 |
| Aug. 29, 1989 | [JP] | Japan | 1-222602 |
| Aug. 29, 1989 | [JP] | Japan | 1-222603 |
| Aug. 27, 1990 | [JP] | Japan | 2-224851 |

[51] Int. Cl.[6] ..... B41U 2/05; B41U 29/02

[52] U.S. Cl. ..... 347/108; 346/145; 347/49; 347/86

[58] Field of Search ..... 347/108, 37, 49, 347/104, 22, 86, 85, 8; 346/145

[56] References Cited

U.S. PATENT DOCUMENTS

| | | | |
|---|---|---|---|
| 4,177,471 | 12/1979 | Mitchell | 347/37 X |
| 4,313,124 | 1/1982 | Hara | 347/57 |
| 4,345,262 | 8/1982 | Shirato et al. | 347/10 |
| 4,386,838 | 6/1983 | Hirabayashi et al. | 355/3 DR |
| 4,459,600 | 7/1984 | Sato et al. | 347/56 X |
| 4,463,359 | 7/1984 | Ayata et al. | 347/56 |
| 4,496,959 | 1/1985 | Frerichs | 347/86 |
| 4,506,277 | 3/1985 | Terasawa | 347/24 |
| 4,544,931 | 10/1985 | Watanabe et al. | 347/37 X |
| 4,558,333 | 12/1985 | Sugitani et al. | 346/107 R |
| 4,559,543 | 12/1985 | Toganoh | 347/32 |
| 4,581,618 | 4/1986 | Watanabe | 347/104 X |
| 4,682,188 | 7/1987 | Castellano | 347/49 |
| 4,692,778 | 9/1987 | Yoshimura | 347/108 |
| 4,723,129 | 2/1988 | Endo et al. | 347/56 X |
| 4,728,970 | 3/1988 | Terasawa | 347/30 |
| 4,740,796 | 4/1988 | Endo et al. | 347/56 |
| 4,757,331 | 7/1988 | Mizusawa | 347/85 |
| 4,772,899 | 9/1988 | Mamiya | 347/37 X |
| 4,775,871 | 10/1988 | Abe et al. | 347/85 |

(List continued on next page.)

FOREIGN PATENT DOCUMENTS

| | | | |
|---|---|---|---|
| 0261764 | 3/1988 | European Pat. Off. | B41J 27/18 |
| 3542053 | 6/1987 | Germany | B41J 27/00 |
| 54-56847 | 5/1979 | Japan | B52M 5/26 |
| 59-123670 | 7/1984 | Japan | B41J 3/04 |
| 59-138461 | 8/1984 | Japan | B41J 3/04 |
| 60-71260 | 4/1985 | Japan | B41J 3/04 |
| 8-206658 | 10/1985 | Japan | B41J 3/04 |
| 37954 | 2/1988 | Japan | B41J 3/04 |
| 1582781 | 1/1981 | United Kingdom | B41J 3/04 |
| WO88/04610 | 6/1988 | WIPO | B41J 3/04 |

*Primary Examiner*—Joseph Hartary
*Attorney, Agent, or Firm*—Fitzpatrick, Cella, Harper & Scinto

[57] ABSTRACT

An ink jet recording apparatus and an ink cartridge for use in this apparatus are disclosed. The recording apparatus has a transport unit for transporting the recording medium, a recording unit having a carriage portion on which a recording head capable of discharging an ink supplied from an ink containing portion to effect recording is mounted, and a recovery unit capable of restoring the function of discharging the ink through the discharge port. The transport unit, the recording unit and the recovery unit are independently separable from each other. Ink passages for communication between the ink containing portion and the recording head can be disconnected while being shut off in each unit. The ink cartridge has a casing, a plurality of ink containers disposed in the casing, and positioning members formed on the ink containers. The ink containers are positioned by engaging the positioning members with each other.

30 Claims, 17 Drawing Sheets

U.S. PATENT DOCUMENTS

| | | | |
|---|---|---|---|
| 4,811,035 | 3/1989 | Huliba | 347/49 X |
| 4,848,945 | 7/1989 | Sone | 346/145 X |
| 4,855,762 | 8/1989 | Suzuki | 347/86 |
| 4,888,602 | 12/1989 | Watanabe | 346/134 |
| 4,951,066 | 8/1990 | Terasawa et al. | 347/33 |
| 4,959,660 | 9/1990 | Suzuki et al. | 347/34 |
| 4,965,596 | 10/1990 | Nagoshi et al. | 347/36 |
| 5,008,688 | 4/1991 | Ebinoma | 347/86 |
| 5,138,343 | 8/1992 | Aichi | 347/30 |
| 5,247,316 | 9/1993 | Komori | 346/160 |

INK JET RECORDING APPARATUS AND CARTRIDGE FOR USE IN THE SAME

This application is a continuation of application Ser. No. 08/367,764 filed Jan. 3, 1995, now abandoned, which is a continuation of application Ser. No. 07/936,740 filed Aug. 31, 1992, abandoned, which is a continuation of application Ser. No. 07/574,084 filed Aug. 29, 1990, abandoned.

BACKGROUND OF THE INVENTION

1. Field of the Invention

This invention relates to an ink jet recording apparatus for effecting recording on a recording medium by discharging ink through a discharge port and to an ink cartridge for use in the recording apparatus. More particularly, this invention relates to an apparatus having separable units having different functions and independently attached to the apparatus.

For example, the separable units comprise a main body unit, a feed unit, a recording unit and a recovery unit and so on which form, for example, an ink jet apparatus when connected. The separable units also comprise, for example, ink container members which form, for example, an ink cartridge when connected. The apparatus comprises, for example, an ink jet recording apparatus or an ink cartridge.

2. Related Background Art

Conventionally, a type of ink jet recording apparatus for effecting recording by jetting droplets of ink through a nozzle of a recording head according to recording data has a section for transporting a recording medium, a section on which the recording head is mounted, a recovery unit for preventing an ink supply passage and the nozzle from clogging and for recovering each of the passage and the nozzle from a clogged state.

Referring to FIG. 1 which is a schematic perspective view of a conventional ink jet recording apparatus of this type, a transport roller 504 for transporting a recording medium is axially supported through a shaft 3 on chassis 501 and 502 and is driven by a driving source (not shown) through a belt transmission mechanism 505. The recording medium is transported while being guided by a paper pan 506 and a guide plate 507. Recording heads 508 to 511 having a plurality of ink discharge ports are mounted on a carriage 512 which is supported and guided by a pair of guide rails 513 fixed between the chassis 501 and 502 and which is moved for scanning by a driving source (not shown) through a belt 514. An interchangeable ink cartridge 515 is connected to the carriage 512 by a supply pipe 516 to supply ink to the recording heads 508 to 511. A recovery unit 517 has caps 518 to 521 reciprocatively moved by a driving source (not shown), and a pump for producing a pressure by the driving source.

The transport portion, the head mount portion, the recovery unit 517 and so on are integrally assembled on the chassis 501 and 502 and chassis 522 and 523.

This conventional apparatus, however, can be actually used for recording to confirm whether or not the apparatus works correctly only after the overall assembly has been completed. If a malfunction takes place, troublesome operations for dismounting the components for repair of the malfunctioning portion and thereafter reassembling the components are required. It is also required to inspect the reassembled components again. Moreover, once the ink flow into the ink supply passages, it is necessary to employ means for copying with the outflow of the ink during the operation of disconnecting intermediate portions of the passage. This operation is very difficult in respect of maintenance also. It is sometimes necessary to interchange the whole of the recording unit, which is very wasteful.

In the field of electrophotography, U.S. Pat. No. 4,386,838 (patented on Jun. 7, 1983) discloses an arrangement using independently separable units. In this arrangement, each of the units, e.g., a developing device and a cleaning device, is made separable. However, the invention disclosed in that publication relates to the field of electrophotography different from that of ink jet recording and therefore any consideration is paid to use of ink including supply of ink to the recording head.

On the other hand, the construction of a known type of ink cartridge formed by fixing a plurality of ink containers is as described below. An ink jet recording apparatus which effects recording by discharging ink through a discharge port of a recording head according to recording data is provided with an ink cartridge for supplying ink to the recording head. Specifically, for color ink jet recording apparatus, a cartridge having a plurality of ink containers having ink of different colors housed in one casing has been proposed.

FIG. 2 is a partially fragmentary schematic perspective view of a conventional ink cartridge. In FIG. 2 the ink cartridge 531 has a casing 532 in which ink containers 533 in the form of a bladder containing inks of three colors are accommodated. Holes 534 through which the respective color inks are extracted are formed. Needles 537, 538, and 539 positioned to face the ink extraction holes 534 are mounted on joint bases 535 and 536 provided on a recording apparatus (not shown). The needles 537 to 539 communicate with supply pipes 540, 541 and 542 connected to a recording head.

The inks provided in the ink cartridge are thereby supplied from the ink containers 533 to the recording head through the needles 537 to 539 and the supply pipes 540 to 542.

FIG. 3 is a partially exploded perspective view of a cartridge 551, showing the internal construction of this cartridge. Each of ink containers 553 is formed of an ink container bladder 563, an ink extraction hole member 564 and a cap 565. A partition plate 566 has a U-shaped groove 566*a* corresponding to the shape of the extraction hole members 564. A rib 552*a* is formed on a casing 552 and a U-shaped groove 552*b* is formed on the rib 552*a*.

In this construction, the ink containers 553 are positioned by being pinched at the extraction hole members 564 between the groove 552*b* of the casing 552, the groove 566*a* of the partition plate 566 and an unillustrated lid member.

In this conventional type of cartridge, however, there is a possibility of each ink container 553 rotating in the grooves 552*b* and 566*a* so that an unnecessary force is applied to the ink container to pressurize the ink. The discharge performance of the recording head is affected by the change in the ink pressure thereby caused, resulting in a deterioration in printing qualities or, in the worst case, occurrence of a leak of the ink. In addition, unless the partition plate 566 is firmly fixed to the casing 552, each ink container 553 can be easily shifted from the correct position. In such an event, it is difficult to correctly insert the needles 557 to 559. There may be also a risk of the partition plate 566 being moved by vibration, resulting in damage of the casing 552.

Problems relating to filling of ink into the ink containers are also encountered as described below.

Ink is injected or filled in one of two different ways. That is, ink having different colors are filled into the ink containers 553 after the ink containers have been set in the casing 552, or the ink is filled after the formation of the ink containers, and the ink containers containing the respective color inks are set in the containers 552.

However, if, in the case of the above-described conventional cartridge, ink is filled after the setting of the cartridge, a leak of the ink which may occur in each ink container 553 cannot be checked easily since the casing 552 is already formed. In a case where the ink is previously filled into the ink containers 553, there is a possibility of failure to set the containers in the proper positions in the casing 552 because the containers are equal in shape, although ink leak checking can be performed easily.

SUMMARY OF THE INVENTION

An object of the present invention is to provide an ink cartridge and an ink jet recording apparatus each capable of mounting independently separable units.

Another object of the present invention is to provide an ink cartridge and an ink jet recording apparatus each improved in assembly and reliability.

Still another object of the present invention is to provide an ink jet recording apparatus having separable units designed in consideration of use of ink including supply of ink to the recording head.

A further object of the present invention is to provide an ink jet recording apparatus capable of maintaining improved recording qualities while using independently separable units.

A still further object of the present invention is to provide, in consideration of the above-described problems, an ink jet recording apparatus improved in producibility, reliability and maintainability.

A still further object of the present invention is to provide an ink jet recording apparatus in which a transport unit, a carriage unit, a recovery unit are made independently separable to enable assembly/inspection of each single unit, and which is thereby remarkably improved in producibility, reliability and facility of maintenance service.

A still further object of the present invention is to provide an ink jet recording apparatus arranged to enable ink supply passages to be shut off in respective single units and to thereby prevent ink from leaking out even when each unit is dismounted after ink charging.

A still further object of the present invention is to provide, in consideration of the above-described problems, an ink cartridge capable of preventing rotation of an ink container to improve the ink supply reliability and to substantially eliminate the risk of ink leakage due to vibration or the like at the time of transportation.

A still further object of the present invention is to provide an ink cartridge for ink jet recording apparatus which has a plurality of ink containers disposed in one casing, in which each of the ink containers has a rectangular flange portion, and in which the ink containers are positioned in the direction of disposition by bringing the rectangular flanges into abutment on each other.

A still further object of the present invention is to provide an ink cartridge capable of preventing rotation of the ink containers, capable of easily and correctly positioning the ink containers on a portion for connection to the recording device, improved in reliability in supplying inks, and capable of sufficiently reducing the risk of ink leakage caused by severe vibration or impacts during transportation.

A still further object of the present invention is to provide, in consideration of the above-described problems, an ink cartridge which facilitates leakage checking after inks have been filled into the ink containers, and in which the ink containers can be correctly set in the casing after filling of the ink.

A still further object of the present invention is to provide an ink cartridge for ink jet recording apparatus which has a plurality of ink containers disposed in one casing, and in which the ink containers are formed of members having portions differently shaped with respect to the colors of contained ink.

A still further object of the present invention is to provide an ink cartridge in which the color ink containers are formed of members having portions differently shaped to enable leakage checking to be performed easily with improved reliability after inks have been filled into the ink containers and to facilitate discrimination of the correct position of each ink container after filling of the inks to eliminate setting errors.

Other and further objects of this invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENTS

Preferred embodiments of the present invention will be described below with reference to the accompanying drawings.

First, an ink jet recording apparatus will be described below in which independently separable units are connected and which thereby effects recording on a recording medium.

The ink jet recording apparatus described below has a transport unit including transport means for transporting a recording medium and a driving source for driving this transport means; a carriage unit including a carriage on which recording heads are mounted and which effects scanning on the recording medium, and a carriage scanning driving source; and a recovery unit including caps, a pressure generation source and a driving source for driving the caps and the pressure generation source. In this apparatus, the transport unit, the carriage unit and the recovery unit are independently separable, and ink supply passages can be closed off in each single unit.

Details of the present invention will be described below with reference to an embodiment illustrated in the following figures.

Figure 1:
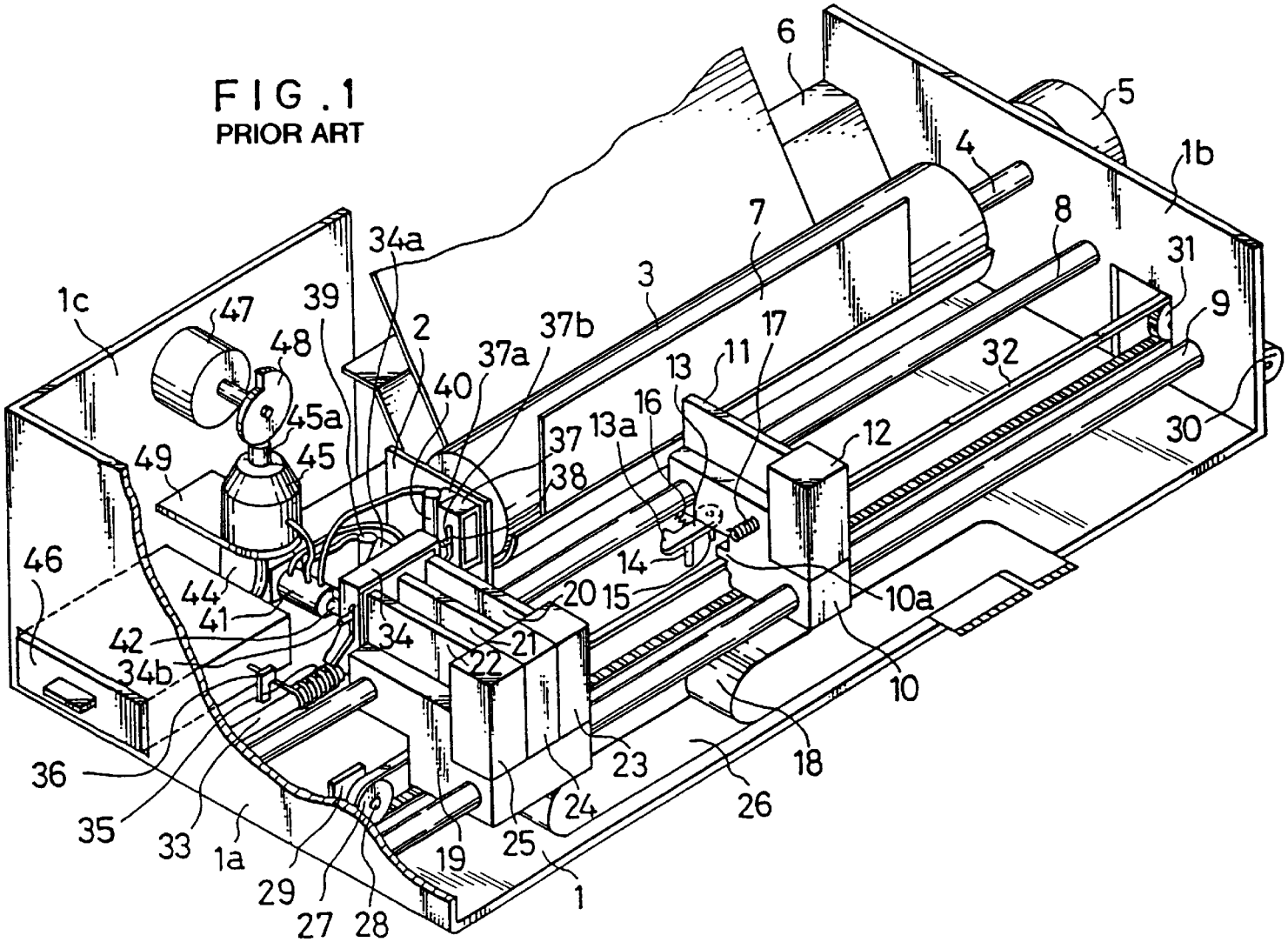
FIG. 1 PRIOR ART
FIG. 1 is a schematic perspective view of an example of the conventional ink jet recording apparatus.
Figure 2A:
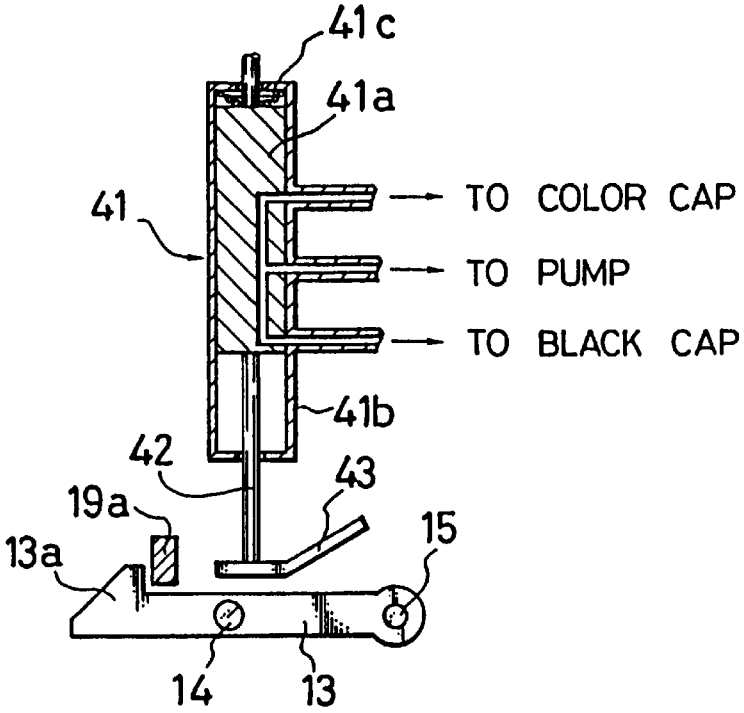
FIG. 2A PRIOR ART
FIG. 2 is a partially fragmentary schematic perspective view of a conventional ink cartridge.
Figure 2B:
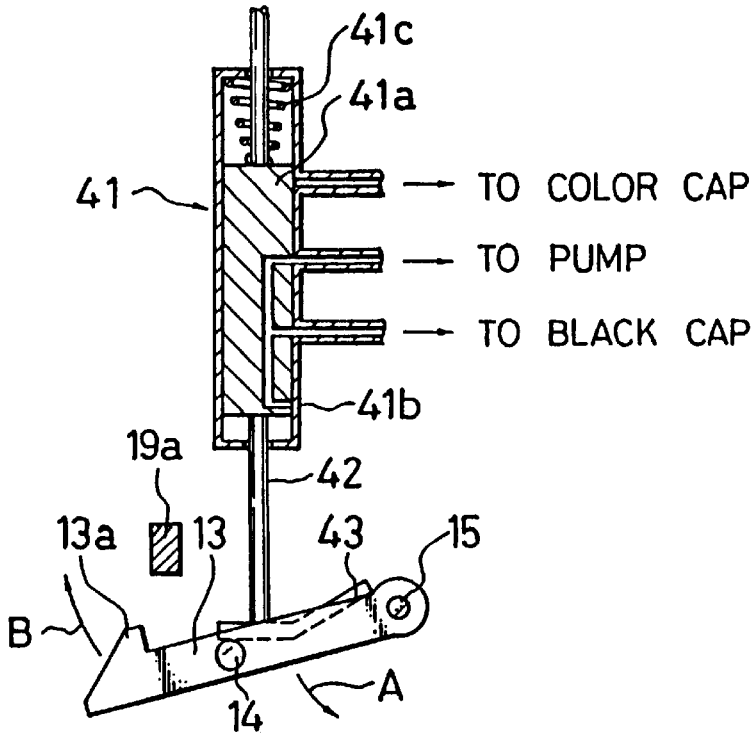
FIG. 2B PRIOR ART
Figure 3A:
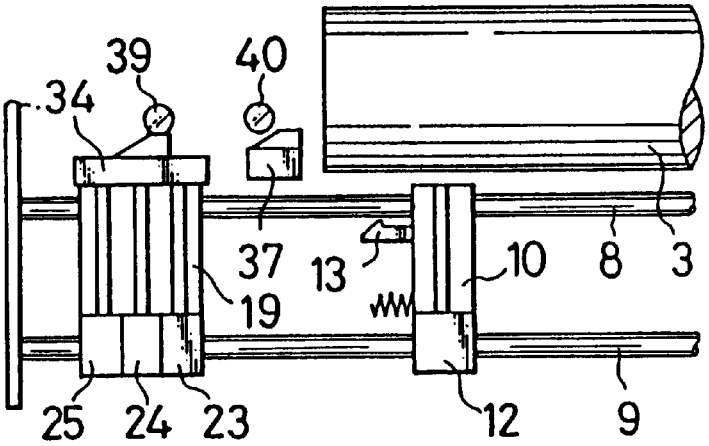
FIG.3A PRIOR ART
FIG. 3 is a partially exploded perspective view of a conventional ink cartridge.
Figure 3B:
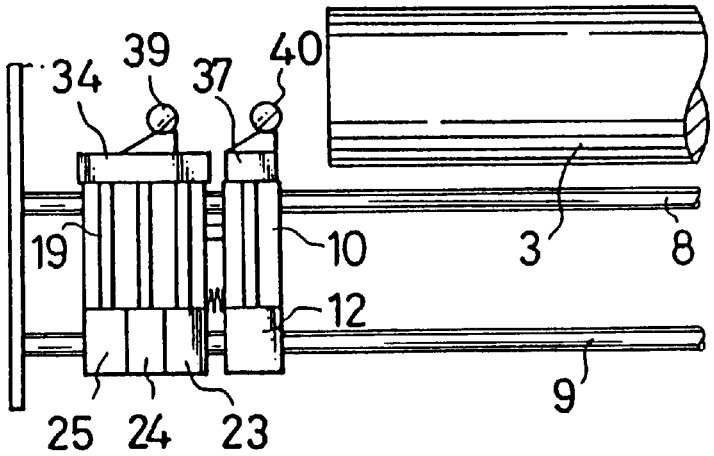
FIG.3B PRIOR ART
Figure 3C:
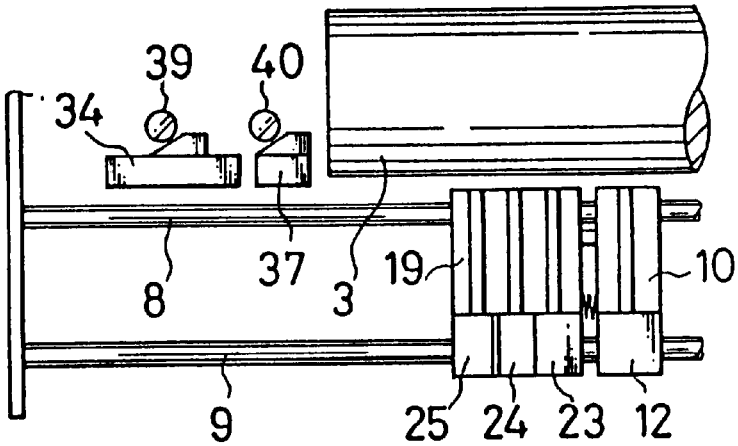
FIG.3C PRIOR ART
Figure 4:
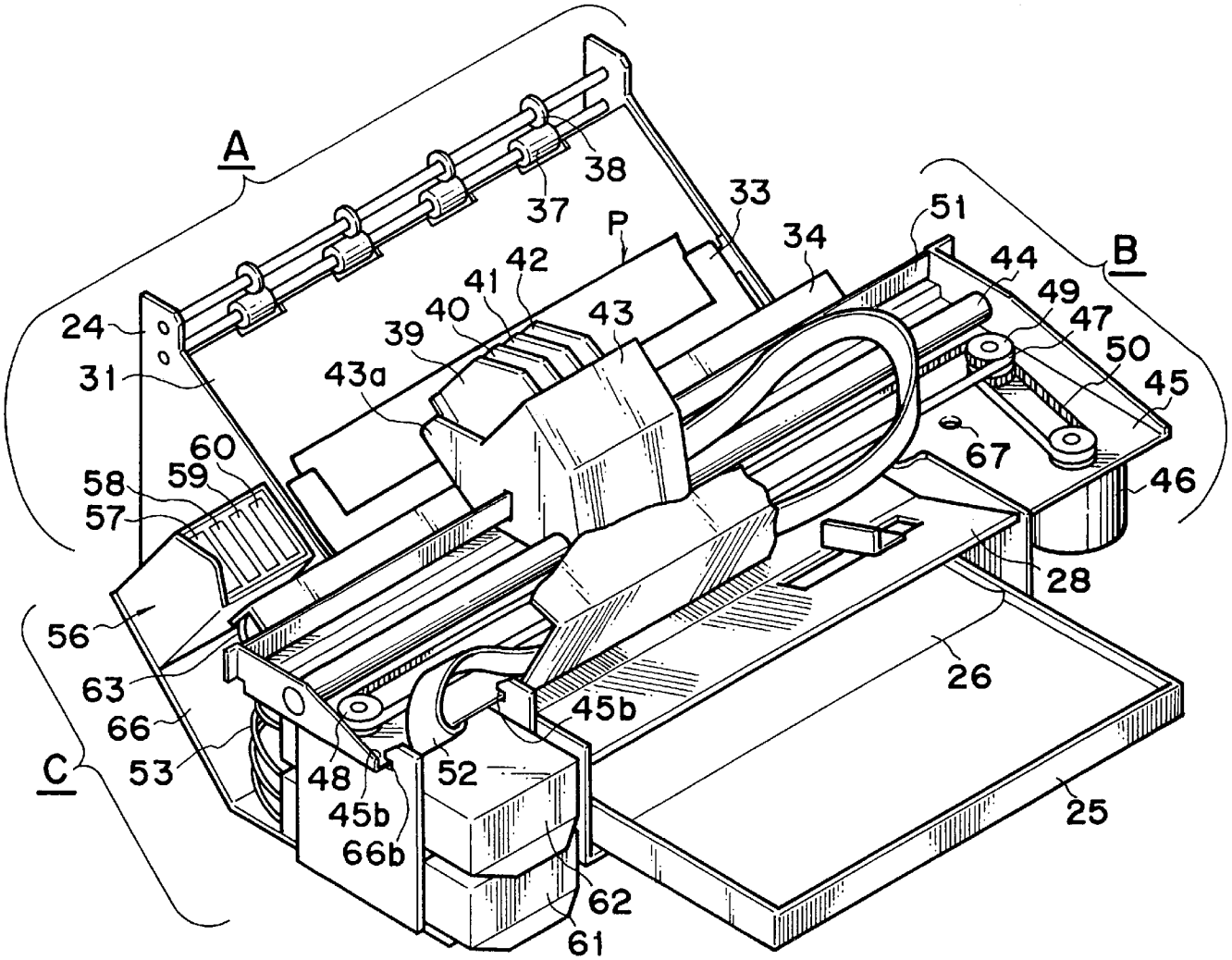
FIG. 4 is a perspective view of an ink jet recording apparatus in accordance with an embodiment of the present invention.
Figure 5A:
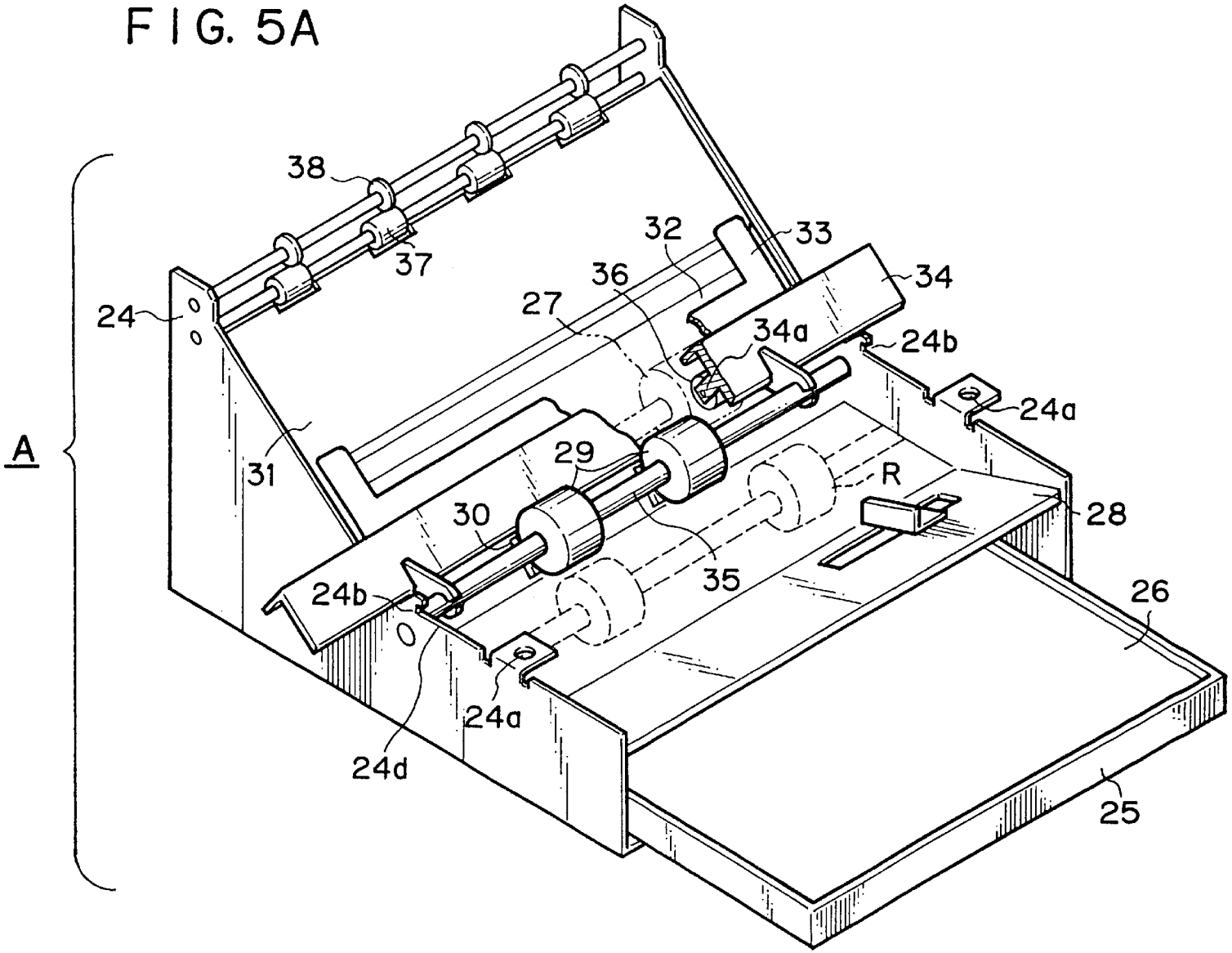
FIG. 5A is a perspective view of a transport unit in accordance with the embodiment of the invention.
Figure 6:
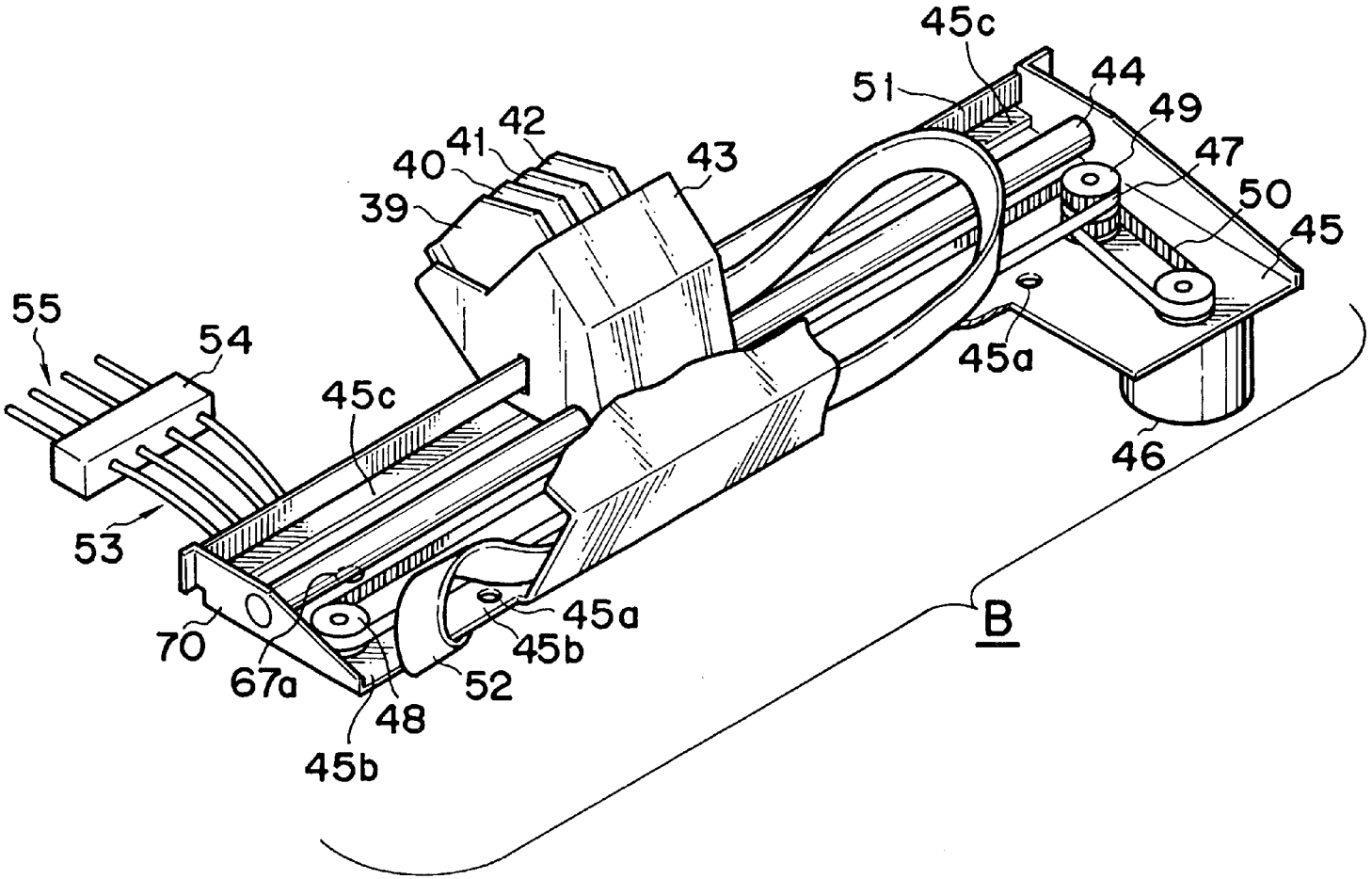
FIG. 6 is a diagram of a recording unit in accordance with the embodiment of the invention.
Figure 7:
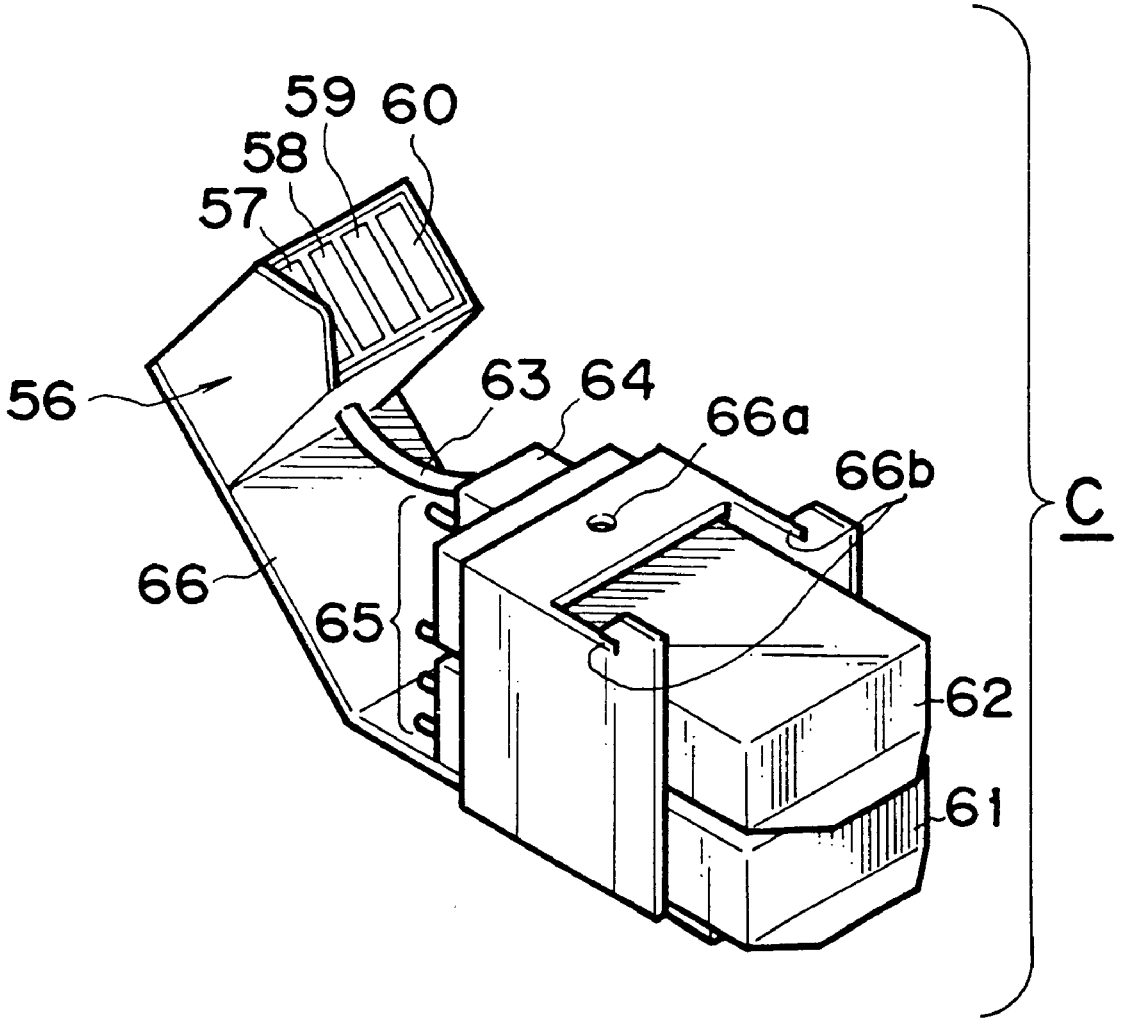
FIG. 7 is a diagram of a recovery unit in accordance with the embodiment of the invention.
Figure 8:
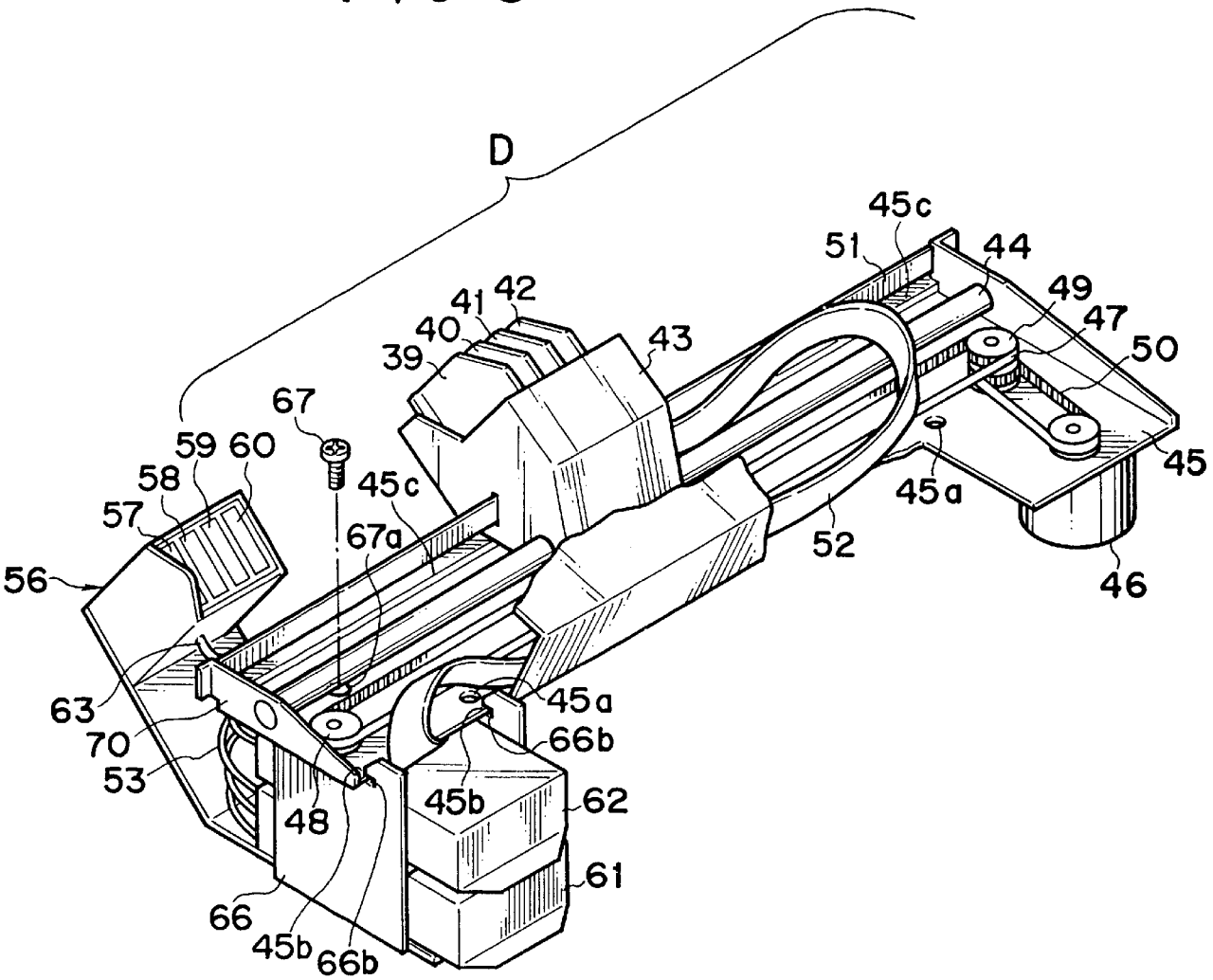
FIG. 8 is a perspective view of the recording unit and the recovery unit in a connected state in accordance with the embodiment of the invention.

FIG. 4 is a perspective view of an ink jet recording apparatus which represents an embodiment of the present invention; FIG. 5A is a perspective view of a transport unit; FIG. 6 is a perspective view of a recording unit (carriage unit); FIG. 7 is a perspective view of a recovery unit; and FIG. 8 is a perspective view of the recording unit (carriage unit) and the recovery unit, showing a connected state of these units.

Referring to FIG. 4, the ink jet recording apparatus has a transport unit A which places, supplies, transports and exhausts a recording medium, a recording unit (hereinafter referred to as "carriage unit") B on which recording heads are mounted and which effects scanning, and a recovery unit C which supplies ink, prevents ink clogging and recovers components from a clogged state.

First, the transport unit A of the ink jet recording apparatus in accordance with the embodiment of the present invention will be described below.

Referring to FIGS. 4 and 5A, the transport unit A has a chassis 24 and a cassette 25 on which recording medium 26 (recording paper or the like) are mounted. In this embodiment, two transport routes for cassette feed and manual feed are formed. The recording medium 26 on the cassette 25 are successively in the downstream direction supplied to transport rollers 27 by rollers R. A placement table 28 is used for manual feed. Feed rollers 29 serve to transport the recording medium 26. Separator pieces 30 abut against the feed rollers 29 by a spring (not shown) to separate the recording medium 26 one after another. Sheet guide plates 31 and 32, a press plate 33 for pressing the recording medium 26 downward, and a guide plate 34 are provided as sheet guide means. The guide plate 34 is rotatably supported on a shaft of the feed rollers 29. The guide plate 34 has a bearing portion 34*a* and rotatably supports contact rollers 36. The contact rollers 36 contact the transport rollers 27. Each recording medium sheet 26 is transported by the transport rollers 27 and the contact rollers 36.

Pairs of exhaust rollers 37 and 38 serve to exhaust each recording medium 26 by pinching it after recording has been effected on the medium. The feed rollers 29, the transport rollers 27 and the exhaust rollers 37 and 38 are driven by a motor (not shown) and a transmission mechanism (not shown) provided on the chassis 24. Tapped holes 24*a* and U-shaped grooves 24*b* for detachably connecting the carriage B and the recovery unit C in a connected state (a main body unit D) to the transport unit A are formed in the chassis 24.

Figure 5B:
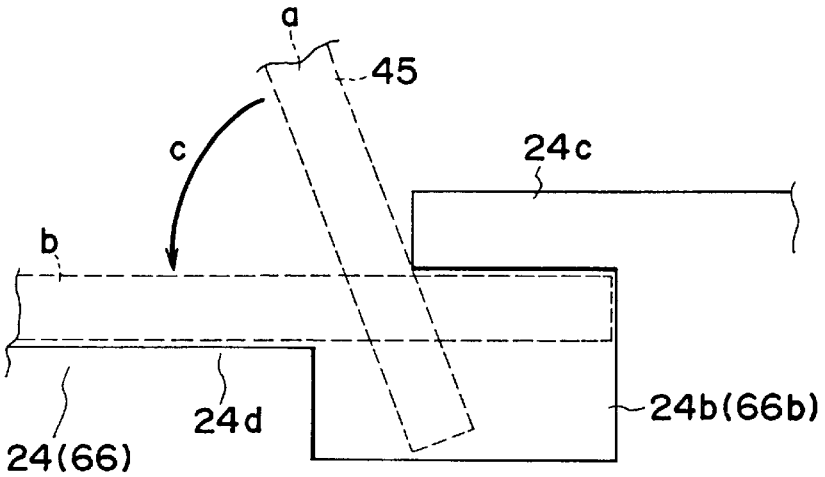
FIG. 5B is a diagram of a connection method in accordance with the embodiment of the invention.

The way of detachably connecting a frame 45 of the main body unit D to the U-shaped grooves 24*b* is as described below in detail with reference to FIG. 5B. The recovery unit C described later is also detachably connected to the carriage unit B in the same way. The frame 45 of the main body unit D is obliquely inserted into each of the U-shaped grooves 24*b* (to a position a shown in FIG. 5B) and is thereafter rotated counterclockwise (in the direction of the arrow c) to a horizontal position (position b). In this position, an upper surface of the frame 45 is restrained by a projection 24C forming a part of the U-shaped groove 24*b* while a lower surface of the frame 45 is restrained by an upper surface 24*d* of the frame 24. Thus, the main body unit D is mounted while positioned on the transport unit A in the vertical direction.

Next, the carriage unit B will be described below.

Referring to FIGS. 4, 6 and 8, recording heads 39 to 42 for printing of, for example, four colors (yellow, magenta, cyan and black) are mounted on a carriage 43. A carriage shaft 44 on which the carriage 43 travels is supported on the frame 45. A motor 46 is disposed under a lower surface of the frame 45. A belt 47 is engaged with the carriage 43 and is stretched between pulleys 48 and 49 to move the carriage 43 by the rotation of the motor 46 through a belt 50. A lengthwise film 51 has a multiplicity of slits arranged in the longitudinal direction. The position of the film 51 is detected by a sensor provided on the carriage to control the motor 46. A cover 52 is provided to protect flexible tubes 53 for supplying the inks to the recording heads 39 to 42. More specifically, the flexible tubes serve to supply the respective color inks from a black ink cartridge 62 and a color cartridge 61 to the recording heads 39 to 42 on the carriage 43. Other ends of the tubes 53 are connected to a joint 54 and another end of the joint 54 is connected to needles 55. Two attachment holes 45*a* to which the transport unit A is detachably connected are formed in the frame 45.

Next, the recovery unit C will be described below.

Referring to FIGS. 4, 7 and 8, the recovery unit C has a recovery device 56 including caps 57 to 60 formed of a flexible material and a suction pump (not shown), the interchangeable replenishment ink cartridges 61 and 62 having internal sections for receiving waste ink discharged from the recovery device 56 through a tube 63 and a joint 64. Outlets 65 corresponding to the respective inks are provided on the joint 64. The recovery device 56, the joint 64 and the ink cartridges 61 and 62 are integrally held on a frame 66. The frame 66 has a tapped hole 66*a* and U-shaped grooves 66*b* for detachably connecting the recovery unit to the carriage B.

The operation of the thus-constructed recording apparatus will be described below with reference to FIG. 4. The recording medium 26 provided in the cassette 25 is supplied to the nip between the transport rollers 27 and the contact rollers 36 by the forwarding rollers R, and is transported to a position P as indicated in FIG. 4 by the transport rollers 27.

At the time of recording, the inks are supplied from the ink cartridges 61 and 62 to the recording heads 39 to 42. Energy generating elements provided in the nozzles are driven according to the recording information to make the inks fly out of the nozzles. Droplets of the inks are thereby attached to and absorbed into the surface of the recording medium 26 to fix recording dots, thereby successively effecting recording. As the recording proceeds, the motor 46 is rotated to reciprocatively move the carriage 42 in the main scanning direction. During this operation, a portion of the carriage 43 slides on the guide plate 34 for scanning along the carriage shaft 44.

The carriage 43 is moved to a position at which it is superposed on the recovery device 56 (hereinafter referred as "recovery position") if a discharge malfunction takes place owing to ink clogging in the nozzles of the recording heads 39 to 42 or attachment of dust to the nozzles, or this movement is effected periodically. At this time, the caps 57 to 60 are in a retracted position and do not obstruct the movement of the carriage 43. When the carriage 43 is at the recovery position, projections 43*a* formed on the carriage 43 are positioned so as to be engaged with holes (not shown) formed in the recovery device 56. After the carriage 43 has been stopped at the recovery position, the caps 57 to 60 are placed on the faces of the recording heads 39 to 42 so as to form closed systems, the suction pump is operated to draw the attached impurities or dust together with ink, and the waste ink is exhausted into the ink cartridge 61 or 62 through the tube 63.

The way of assembly of this recording apparatus will now be described below. The way of detachably connecting the recovery unit C to the carriage unit B will be first described. Referring to FIGS. 6, 7 and 8, the U-shaped grooves 66*b* of the recovery unit C are positioned at engaging portions 45*b* of the chassis 45 of the carriage B and detachably fitted to the same. Then, a screw 67 is inserted into a hole 67*a* of in the chassis 45 corresponding to the tapped hole 66*a* of the recovery unit C and is screwed into this hole to fix the carriage unit B and the recovery unit C to each other. The carriage unit B and the recovery unit C are thereby integrally connected to form the main body unit D. Next, the joint 54 of the carriage unit B and the joint 64 of the recovery unit C are connected to make the needles 5 and the outlets 65 communicate with each other, thereby forming ink supply passages. Thus, the ink supply passages for supplying inks from the ink cartridges 61 and 62 to the recording heads 39 to 42 and the ink passage for collecting ink in the ink cartridge via caps 57 to 60 can be disposed in the same unit based on integrally connecting the carriage unit B and the recovery unit C to form the main body unit. It is thereby possible to markedly reduce the leakage of the inks.

The carriage unit B and the recovery unit C thereby assembled (main body unit D) are combined with the transport unit A shown in FIG. 5A. The main body unit D is detachably connected to the transport unit A as described below. Engaging end portions 45*c* of the frame 45 of the carriage unit B are positioned in the two U-shaped cuts 24*b* formed in the chassis 24 as shown in FIG. 5A and are detachably fitted therein. Then, screws 67 are inserted into the two holes 45*a* of the frame 45 corresponding to the tapped holes 24*a* and are screwed into the same, thereby fixing the main body unit D and the transport unit. The assembly of the ink jet recording apparatus is thereby completed to enable recording.

It is possible to modify the transport unit A to constantly maintain the accuracy with which the distance between the discharge ports of the recording heads and the recording surface of the recording medium is determined after the units have been assembled by being connected, even though the transport unit A, the carriage unit B and the recovery unit C are separable from each other or the main body unit D and the transport unit A are separable. A transport unit Aa designed for this effect in accordance with another embodiment of the present invention will be described below. A transport unit Aa is independently separable from the main body unit D or from the carriage unit B and the recovery unit C as in the case of the transport unit A. Portions for connection to each of the other units are omitted in FIG. 9, but they may be of the same type as those of the above-described embodiment. For ease of understanding of this embodiment, a carriage 43 and recording heads 39 to 42 are also illustrated, which are provided in the carriage unit B as in the case of the above-described embodiment.

Figure 9:
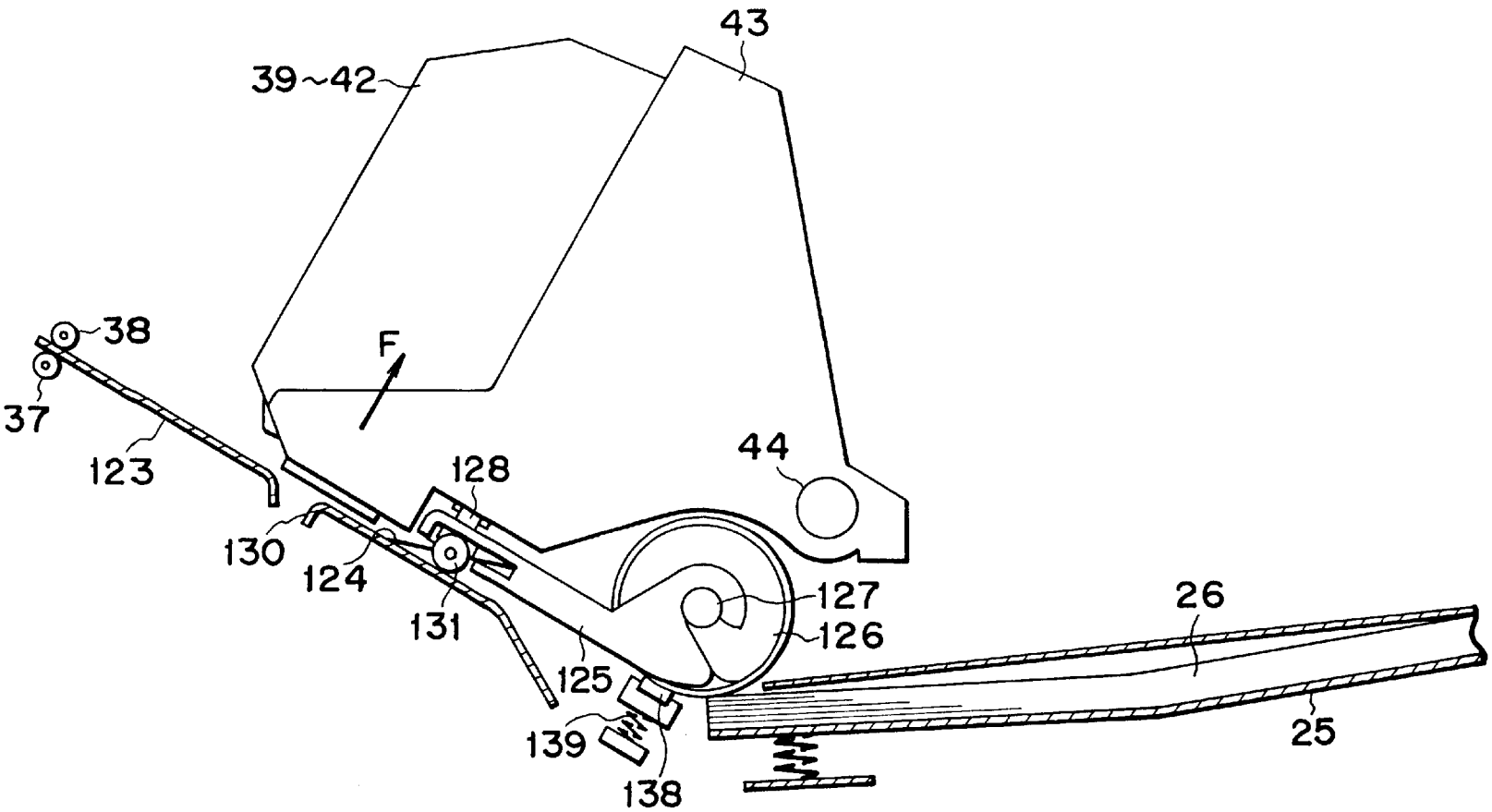
FIG. 9 is a sectional side view of a transport unit having a means for constantly maintaining the distance between the recording head and the recording surface in accordance another embodiment of the invention.

FIG. 9 shows a state in which recording medium sheets 26 are placed on a cassette 25. A slider 128 is provided on a carriage 43. The slider 128 slides on a guide plate 125 while supporting a moment acting on the carriage 43 on a carriage shaft 44 (in the direction of the arrow W). Feed rollers 126 serve to transport each recording medium 26. Separator pieces 138 abut against the feed rollers 126 by a spring 139 to separate the recording medium sheets one after another. Sheet guide plates 123 and 130 are provided as a means for guiding the recording medium 26. A press-down plate 33 serves to press the recording medium 26 downward. The guide plate 125 is rotatably supported on a shaft 127 of the feed rollers 126, and has bearing portions for rotatably supporting contact rollers 131. The contact rollers 131 contact the guide plate 130. When the recording medium 26 is transported between the guide plate 130 and the contact rollers 131, the guide plate 125 rotates on the shaft 127 according to the thickness of the sheet. With this rotation the carriage 43 is rotated clockwise on the shaft 44 with the slider 128 contacting the guide plate 125. Accordingly, the distance between the jet holes of the recording heads 39 to 42 and the recording surface can be constantly maintained irrespective of the thickness of the recording medium 26.

Thus, the transport unit Aa of this embodiment is capable of maintaining the desired distance between the jet holes of the recording heads and the recording surface of the recording medium even though some attachment error occurs when, for example, the transport unit Aa is connected to the main body unit D.

According to the above description, the apparatus units are assembled in order to the carriage unit B, the recovery unit C and the transport unit A. However, the assembly order is not limited to this. For example, these units can be assembled in order of the transport unit A, the carriage unit B and the recovery unit C.

Because the units are constructed separately as described above, each of the transport unit A, the carriage unit B and the recovery unit C can be assembled and checked on a separate production line. In this case, there is no possibility of a malfunction of one of the units A to C influencing the other units. Even if occurrence of a malfunction of, for example, the transport unit A is found after the assembly of the whole of the apparatus has been completed, the unit can be separated only by removing two screws 67; there is no need for an operation which may cause a leak of ink, e.g., disconnecting the ink supply pipes. It is also possible to prevent an ink leak in the carriage unit B and the recovery unit C during disassembly in the case of a malfunction of the carriage unit B or the recovery unit C. That is, the ink supply passages are connected through the joints 54 and 64 between the carriage unit B and the recovery unit C, and these joints may be constructed in such a manner that the outlets 65 are formed of flexible members which are closed by itself but are opened for communication through the supply passages only when the needles 5 are inserted, thereby preventing an ink leak in each of the carriage unit B and the recovery unit C.

Figure 10A:
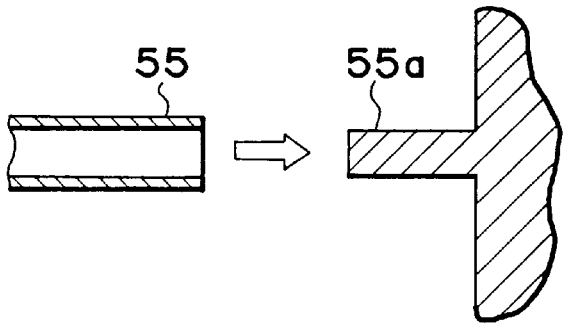
FIGS. 10A and 10B are diagrams of an ink passage shutting off method.
Figure 10B:
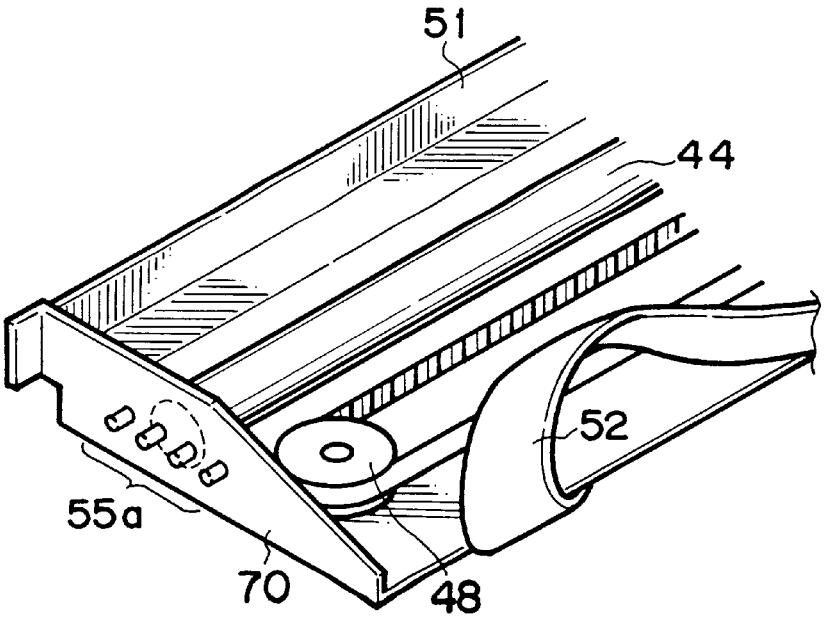

Arrangements for shutting off the ink supply passages will be described below. Referring to FIGS. 10A and 10B, an example of a shut-off structure is illustrated. When the carriage unit B and the recovery unit C are detached from each other, the needles 55 are disconnected from the outlets 65. The needles disconnected from the outlets 65 are fitted to projections 55*a* formed on a side plate 70 of the carriage unit B (as shown in FIG. 10A). The end openings of the needles 55 are thereby closed by the projections 55*a* to prevent the inks from leaking out.

Figure 10C:
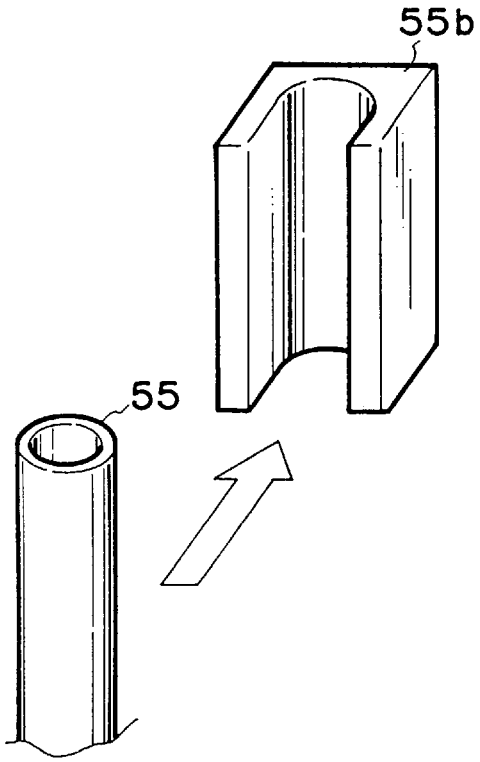
FIGS. 10C and 10D are diagrams of another example of the ink passage shutting off method.
Figure 10D:
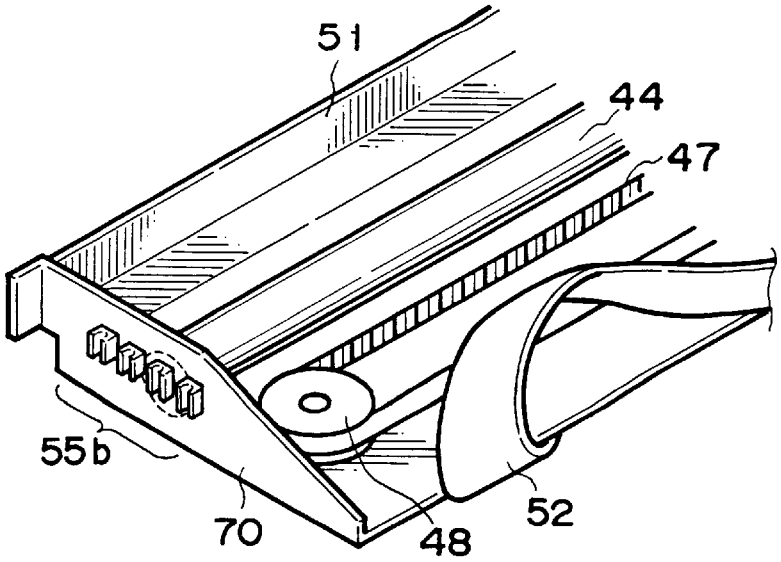

Referring to FIGS. 10C and 10D, another example of the shut-off structure is illustrated. In this example, the needles 55 are restrained by engaging portions 55*b* formed on the side plate 70 with their openings facing upward and maintained at substantially the same height as the jet holes of the recording heads 39 to 42. Substantially equal water heads are thereby maintained in the needles and the recording heads, thereby preventing the inks from leaking out.

Figure 10E:
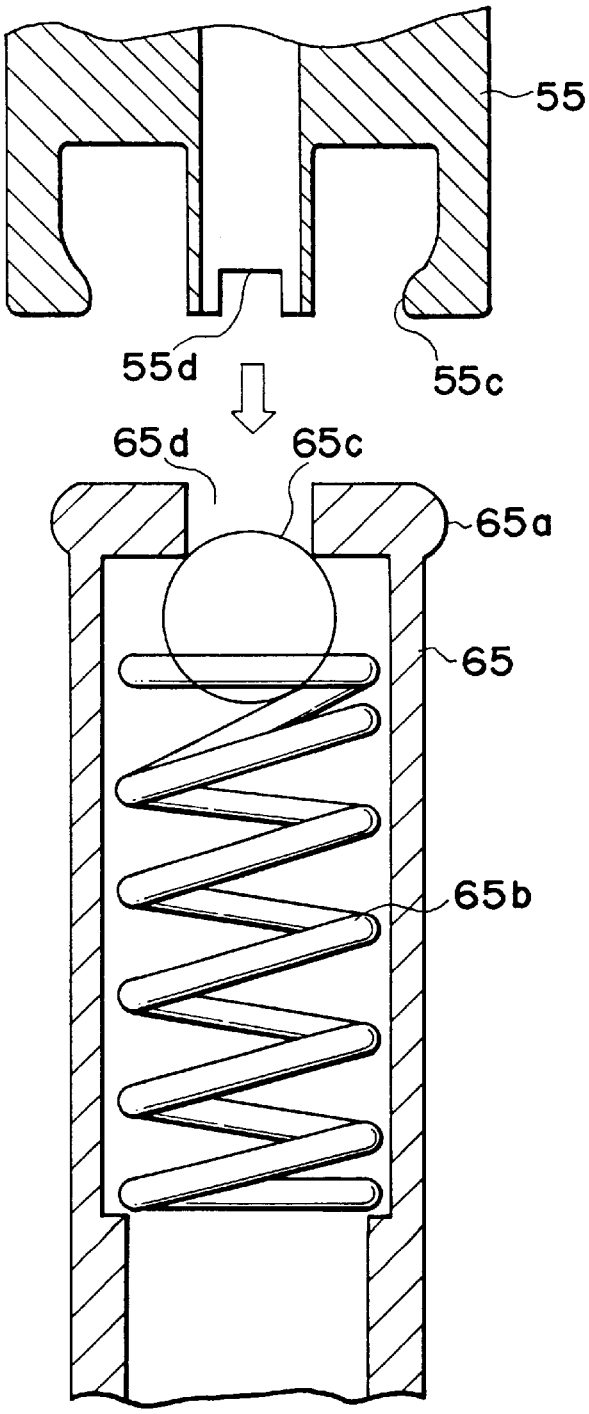
FIG. 10E is a diagram of an ink passage connection method.

Referring to FIG. 10E, another example of each outlet 65 is illustrated. A spring member 65*b* is set inside an outlet 65 so as to urge a sealing ball 65*c* toward the opening 65*d*. The diameter of the opening 65*d* is smaller than that of the sealing ball 65*c*. The opening 65*d* is therefore completely sealed with the sealing ball 65*c*. A corresponding needle 55 having a cut-out portion 55*d* formed at its extreme end is inserted into this opening, and the needle 55 is pressed against the outlet 65 until the needle 55 and the outlet 65 are connected by engagement between small protrusions 55*c* and 65*a*, thereby providing a communication between the ink supply passages of the needle 55 and the outlet 65 through an opening formed by the sealing ball 65*c* and the cut-out portion 55*d*.

In the above-described embodiments, the carriage unit B and the recovery unit C are integrally combined before they are mounted on the transport unit A. However, the present invention can also be achieved by a construction in which the carriage unit B and the recovery unit C are respectively attached to the transport unit A.

The number of recording heads is not necessarily plural. The ink cartridges may be of a type mounted on the carriage.

Figure 5C:
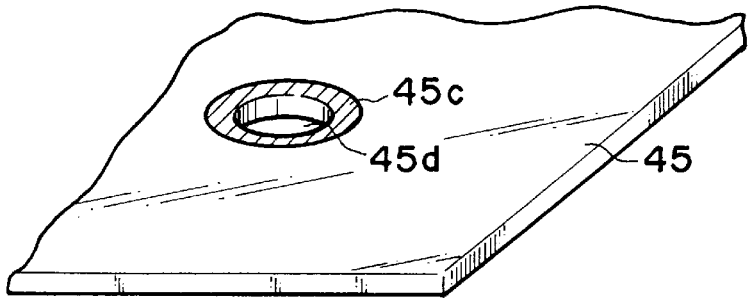
FIGS. 5C and 5D are diagrams of another example of the connection method.
Figure 5D:
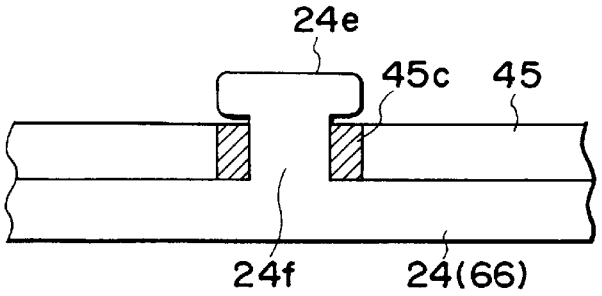

In the above-described embodiments, each unit is connected by fastening with screws. However, the connection means in accordance with the present invention is not limited to this type; another means for detachably connecting the units may be adopted, which will be described below with respect to connection between the transport unit A and the main body unit D. As shown in FIG. 5D, a cylindrical portion 24*f* having a head 24*e* (diameter of head 24*e*> diameter of cylindrical portion 24*f*) is formed on the frame 24 of the transport unit A. On the other hand, as shown in FIG. 5C, a hole 45*d* is formed in the frame 45 of the main body unit D, and an elastic member 45*c* is provided on the inner peripheral surface of the hole 45*d*. The diameter of the hole 45*d* is approximately equal to that of the cylindrical portion 24*f*, and the diameter of the elastic member 45*c* is approximately equal to that of the head 24*e*. To connect the transport unit A and the main body unit D, the head 24*e* of the transport unit A is formed into the frame 45 of the main body unit D. The elastic member 45*c* is thereby deformed outwardly and is engaged with the cylindrical portion 34*f* (in a position shown in FIG. 5D). To disconnect these units, the frame 45 of the main unit D is moved upwardly as viewed in FIG. 5D until the cylindrical portion 24*f* and the elastic member 45*c* are disengaged. Thus, the main body unit D and the transport unit A can be detachably connected.

The above-described transport unit is provided with the cassette, the feed rollers, the transport rollers, the manual feed placement table, the paper guide and so on. However, the transport unit of the present invention may have the feed rollers alone.

The above-described recording unit is provided with the recording head mount portion, the carriage, the belt for reciprocatively moving the carriage, the motor for driving the belt, and so on. However, the recording unit of the present invention may have the recording head mount portion alone.

The above-described recovery unit is provided with the caps, the ink cartridges, the tube, the pump and so on. However, the recovery unit of the present invention may have only a function of removing ink attached in the vicinity of the jet holes by using an absorbing member or the like, provided that the function of jetting inks through the jet holes can be restored.

In accordance with the above-described embodiments, the recording medium transport unit, the carriage unit and the recovery unit are constructed as independently separable units, and each unit can be assembled and checked separately. It is thereby possible to greatly improve the apparatus in both producibility and reliability. Since the ink supply passages can be shut off in each single unit, there is no possibility of a leak of the ink in each unit even if the unit is dismounted after the ink has been filled. The maintainability is thereby improved remarkably. Further, the present invention enables interchange of carriage units differing in recording density to improve the extendability of the recording apparatus, i.e., to grade up the apparatus.

Other embodiments of the present invention will be described below. In an embodiment described below, ink containers provided as separable units constitute an ink cartridge by being connected.

The embodiment described below is an ink cartridge which is used in an ink jet recording apparatus and which has a plurality of ink containers disposed in one casing. Each ink container has a rectangular flange portion, and the ink containers are positioned in the direction of disposition by abutment of the rectangular flange portions. Each of the ink containers has an ink containing flexible sack, an ink outlet member fixed to the ink containing sack, and a cap for tightly closing the ink outlet member.

Details of this embodiment will be described below.

Figure 11:
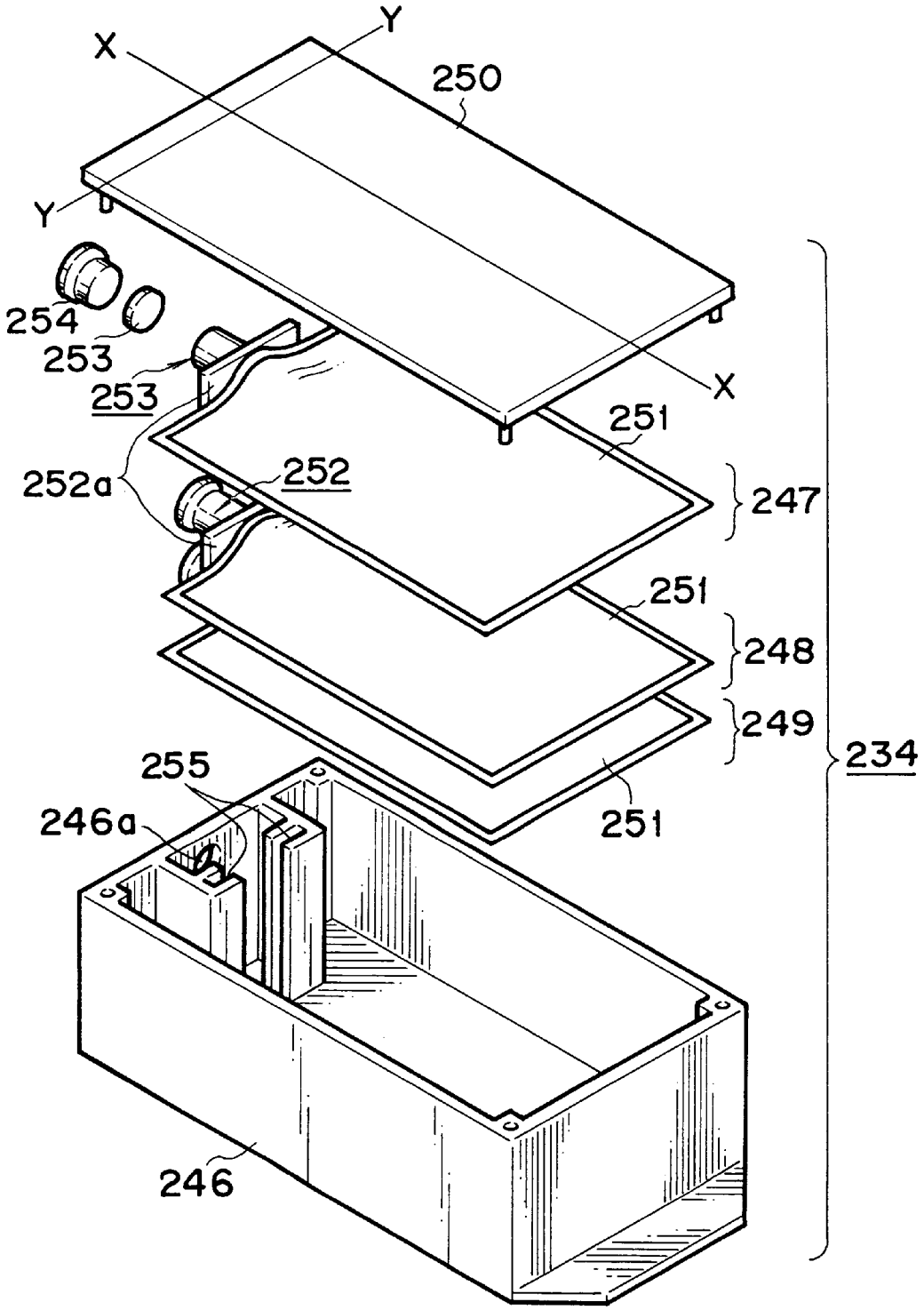
FIG. 11 is an exploded perspective view of an ink cartridge in accordance with still another embodiment of the invention.
Figure 12:
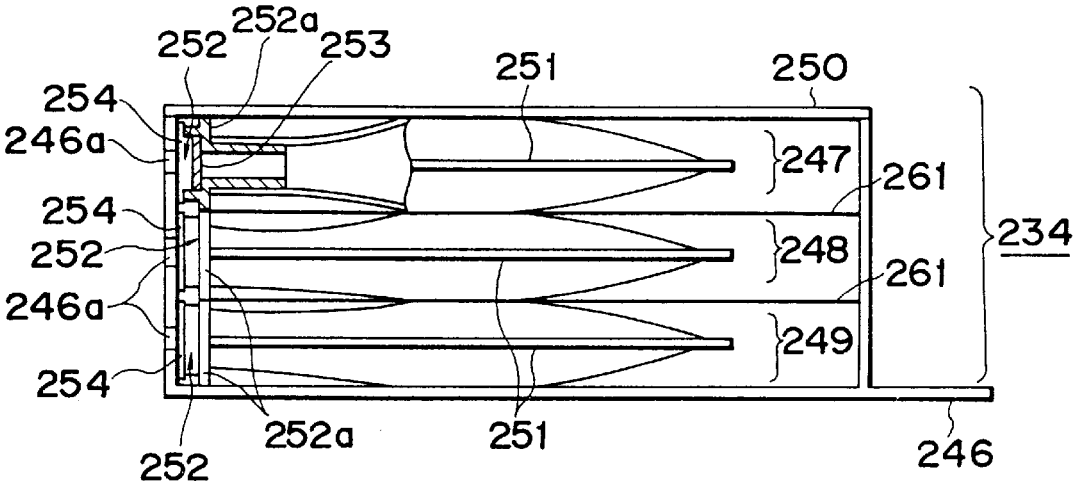
FIG. 12 is a cross-sectional view taken along the line X—X of FIG. 11.

FIG. 11 is an exploded perspective view of an ink cartridge in accordance with the embodiment of the present invention, and FIG. 12 is a cross-sectional view of the ink cartridge taken along the line X—X of FIG. 11. The ink jet recording apparatus shown in FIG. 4 is also referred to as an apparatus in which the ink cartridge of this embodiment is used.

The ink cartridge shown in FIGS. 11 and 12 is a color ink cartridge having a casing 246, ink containers 247 to 249 which contain color inks and which are accommodated in the casing 246, and a cartridge lid member 250 which closes an upper opening of the casing 246. Each of the ink containers 247 to 249 is formed by integrally connecting a flexible ink containing sack 251 to an ink outlet member 252 having a rectangular flange portion 252*a* by, for example, welding means and is tightly closed by lid cap members 253 and 254. Ink outlet holes 246*a* corresponding to the number of colors (which is three in this embodiment) are formed in the casing 246. Slot portions 255 in which the rectangular flange portions 252*a* of the ink outlet members 252 are inserted are also formed on the casing 246.

To assemble the thus-constructed components, the containers 247 to 249 containing the respective color inks are superposed on each other with the rectangular flange portions 252*a* of the ink outlet members 252 inserted into the slot portions 255 of the casing 246. The height of the ink outlet members 252 and the pitch of arrangement of the ink outlet holes 246*a* are set so that the respective color ink containers 247 to 249 are positioned to face the corresponding ink outlet holes 246*a*.

In this construction, the respective color ink containers 247 to 249 can be positioned relative to the corresponding ink outlet holes 246*a* only by being superposed while being guided by the slot portions 255 of the casing 246, thereby improving the reliability with which the inks are extracted. Since the flange portions 252*a* of the ink outlet members 252 are rectangular, a force in the direction of rotation of the ink containers can be supported by the flange portions 252*a*. The ink containers 247 to 249 can therefore be supported with safety and reliability without being damaged by severe vibration or impacts applied during transportation of the cartridge 234, thereby eliminating the risk of leakage and so on. Partition plates 261 are also provided between the ink containing sacks 251 to prevent the ink containing sacks from influencing each other.

Needless to say, the number of ink colors is not limited to three; any number of ink containers may be used so long as the number is plural, and different ink containers may contain the same color ink. In the above-described embodiment, the ink containers 247 to 249 are formed by using the flexible ink containing sack 251 and the ink outlet member 252. However, it may be formed in any other way so long as it is formed separately from the casing and has a flange portion.

Figure 13:
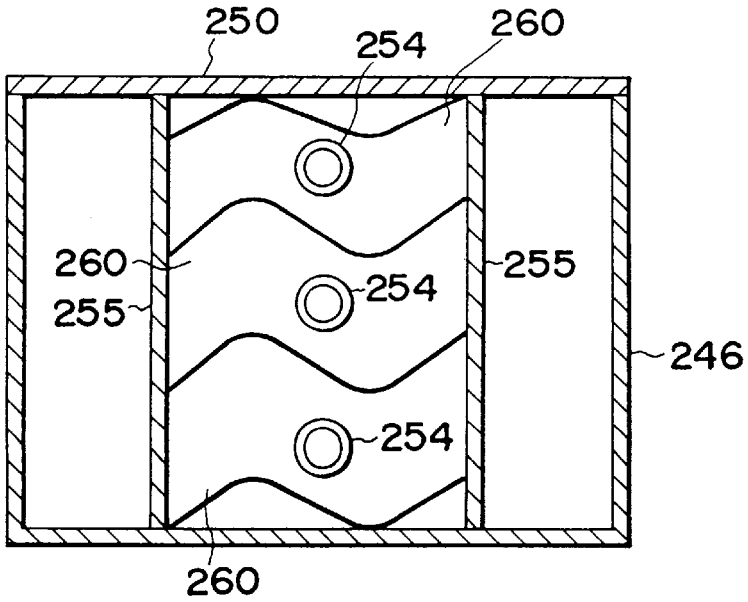
FIG. 13 is a cross-sectional view of another example the flange portion corresponding to a cross-sectional view taken along the line Y—Y of FIG. 11.

FIG. 13 shows another type of flange portion 260 having different shape. FIG. 13 corresponds to a cross-sectional view taken along a line Y—Y of FIG. 11. The flange portion 260 may have a shape including a combination of a recessed portion and the projecting portion. This shape also ensures that the flange portions 260 can be fitted in grooves 255 to be prevented from being inadvertently rotated.

In accordance with the present invention, as described above, a flange portion is formed on each ink container and the flange portions are brought into abutment on each other to position and fix the containers. The ink containers can therefore be positioned on the portion connected to the recording device with improved reliability. The risk of ink leakage caused by severe vibration or impacts during transportation can be markedly reduced.

A further embodiment of the present invention will be described below with reference to FIGS. 14, 15 and 16. The embodiment described below is an ink cartridge which is used in an ink jet recording apparatus and which has a plurality of ink containers disposed in one casing. The ink containers contain color inks and have portions differently shaped with respect to colors. Ink outlet members of the respective color ink containers may have rectangular flange portions having different widths. The different shapes of the respective color ink containers may include a projection and a groove or hole fitted to the projection. The portions of the respective color ink containers differing in shape may have different colors.

Details of this embodiment will be described below.

Figure 14:
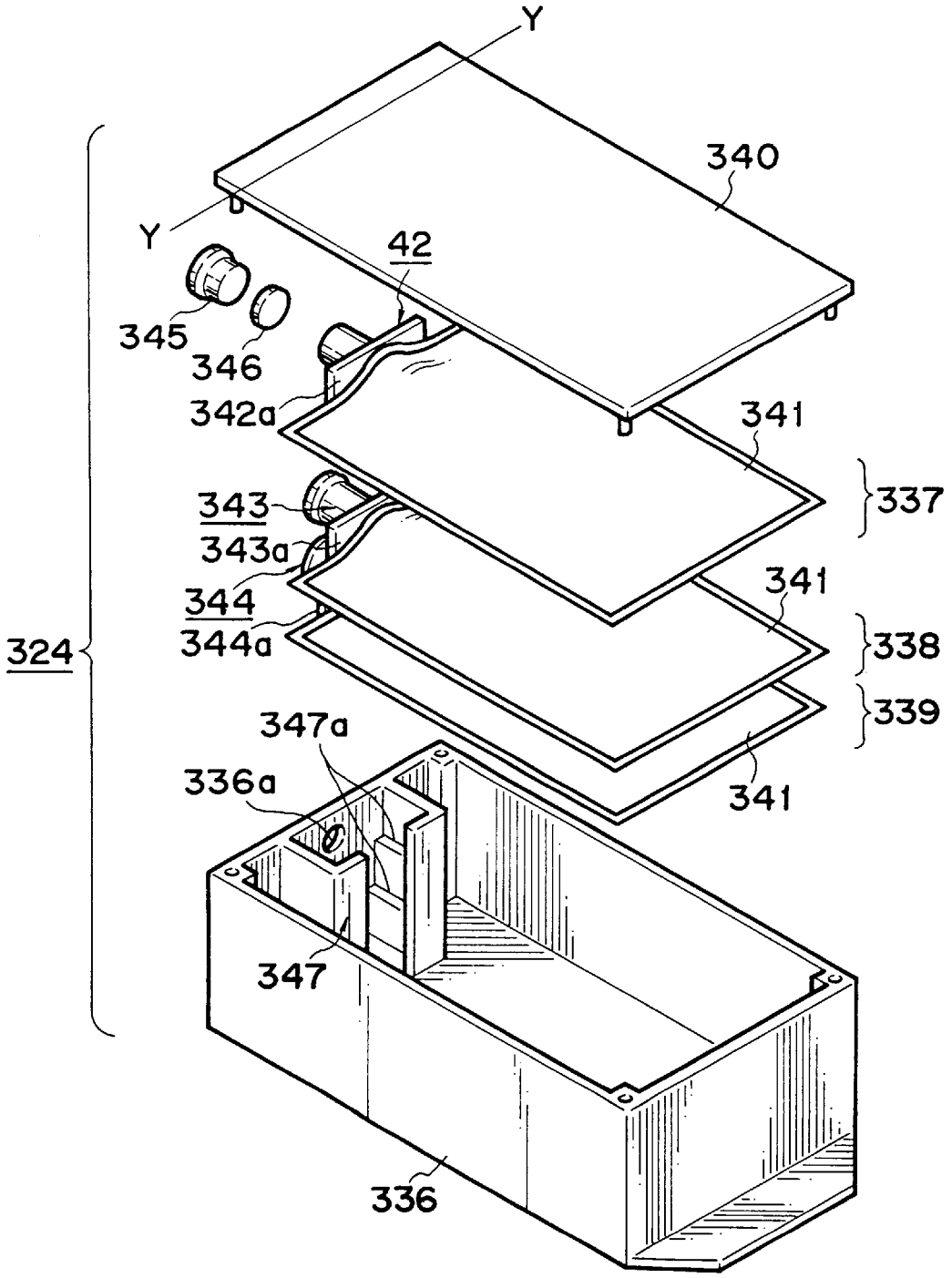
FIG. 14 is an exploded perspective view of an ink cartridge in accordance with a still further embodiment of the invention.
Figure 15:
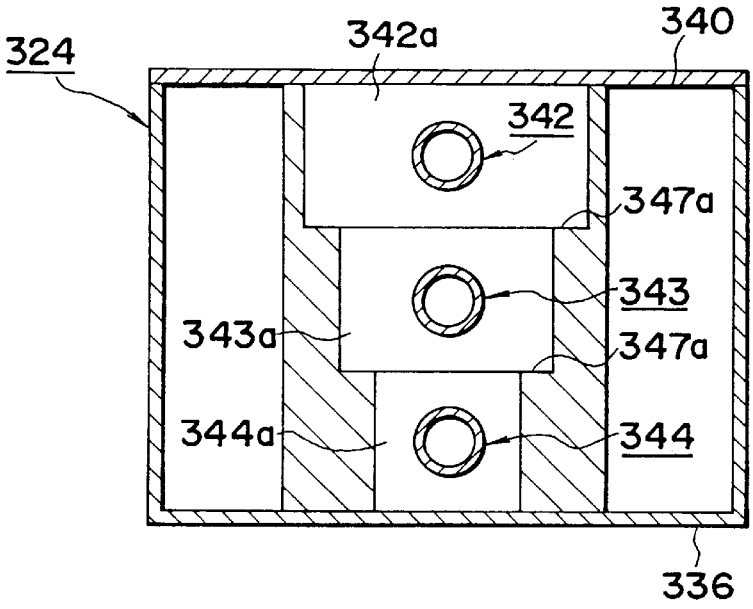
FIGS. 15 and 16 are cross-sectional views taken along the line Y—Y of FIG. 14.

FIG. 14 is an exploded perspective view of an ink cartridge in accordance with this embodiment of the present invention, and FIG. 15 is a cross-sectional view of the ink cartridge taken along the line Y—Y of FIG. 14. The ink jet recording apparatus shown in FIG. 4 is also referred to as an apparatus in which the ink cartridge of this embodiment is used.

The ink cartridge shown in FIGS. 14 and 15 is a color ink cartridge having a casing 336, ink containers 337 to 339 which contain color inks and which are accommodated in the casing 336, and a cartridge lid member 340 which closes an upper opening of the container 336. The ink containers 337 to 339 are formed in such a manner that flexible ink containing sacks 341 are integrally connected by, for example, welding to ink outlet members 342 to 344 having rectangular flange portions 342*a* to 344*a* having different widths with respect to the colors. The ink outlet members 342 to 344 are tightly closed by lid cap members 345 and 346. Ink outlet holes 336*a* corresponding to the number of colors (which is three in this embodiment) are formed in the casing 336. Slot portions 347 having steps 347*a* are also formed on the casing 246. The widths of the steps 347*a* correspond to the different widths of the ink outlet members 342 to 344.

To assemble the thus-constructed components, the containers 337 to 339 containing the respective color inks are superposed on each other with the ink outlet members 342 to 344 inserted into the slot portions 347 of the casing 336. As shown in FIG. 15, the steps 347*a* corresponding to the rectangular flange portions 342*a* to 344*a* of the ink outlet members 342 to 344 having different widths with respect to colors are formed on the slot portions 347 of the casing 336, and the ink outlet members 342 and 344 are inserted to be set in the correct positions on the steps.

In the thus-constructed cartridge, each of the color ink containers 377 to 339 for one color cannot be inserted or fitted at the positions determined for the other colors. It is therefore easy to discriminate an incorrectly inserted state. Accordingly, in a case where a malfunction such as ink leakage is confirmed after the inks have been injected into the corresponding ink containers 337 to 339, the ink containers can be correctly set to the positions determined for the respective colors. Specifically, the different shapes of the rectangular flange portions 342*a* to 344*a* of the ink outlet members 342 to 344 facilitate discrimination with respect to the colors, and the provision of the steps 347*a* makes it possible to easily detect an insertion error and, hence, to prevent occurrence of insertion errors. If the color tones of the ink outlet members 342 to 344 are matched with the colors of the injection inks, the discrimination is further facilitated. It is thus possible to provide an ink cartridge free from the risk of ink leakage and improved in reliability and producibility.

Figure 16:
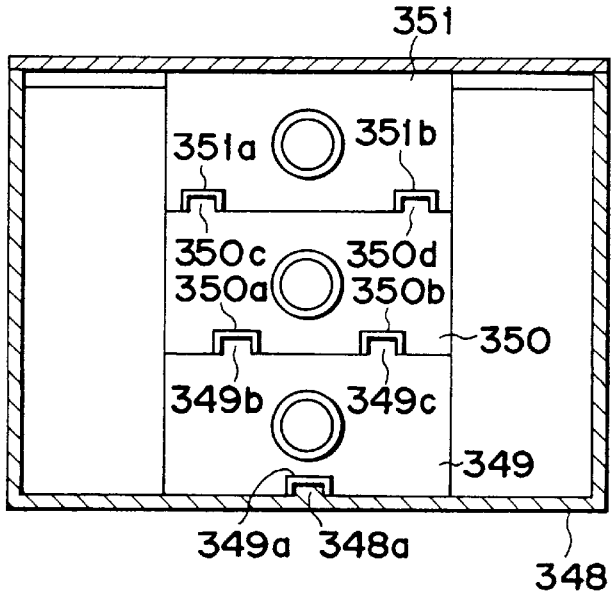

FIG. 16 is a cross-sectional view of an ink cartridge in accordance with a still further embodiment of the present invention. This embodiment includes specific changes in the shape of ink outlet members. The description for the portions corresponding or identical to those of the above-described embodiment will not be repeated. Referring to FIG. 16, a projection 348*a* is formed on the bottom of a casing 348. The projection 348*a* is fitted to a hole 349*a* formed in the lower surface of an ink outlet member 349 disposed in the lowermost position to put out a color ink. Projections, i.e., two projections 349*b* and 349*c* are formed on the upper surface of the ink outlet member 349 so as to be fitted to two holes 350*a* and 350*b* formed in the lower surface of another ink outlet member 350 for another color ink. Further, projections 350*c* and 350*d* are formed on the upper surface of this ink outlet member 350 in positions in the widthwise direction different from those of the fitting portions in the lower surface. These projections are fitted to two holes 351*a* and 351*b* formed in the lower surface of a further ink outlet member 351 for a different color ink.

It is thus possible to easily discriminate the correct position of each ink outlet member based on whether or not the ink outlet member can be fitted depending on the positional relationship between the projections 348*a*, 349*b*, 349*c*, 350*c*, and 350*d* and the holes (or grooves) 349*a*, 350*a*, 350*b*, 351*a*, and 351*b*.

In accordance with the present invention, as described above, the respective color ink containers have members partially differing in shape from each other. It is therefore easy to check ink leakage with improved reliability after inks have been injected into the ink containers as well as to discriminate the proper positions of the containers when the containers are set in the casing after the injection to eliminate the possibility of any disposition error. The ink cartridge of the present invention can therefore be greatly improved in reliability and producibility.

The present invention can be applied to any other type of ink jet recording system, e.g., one using electromechanical converters such as piezoelectric elements. However, the present invention is specifically effective when applied to the bubble jet type ink jet recording head or recording apparatus proposed by Canon Inc, because this type of apparatus enables improvements in recording density resolution.

For a typical construction and a principle of this type of apparatus, a basic principle disclosed in, for example, U.S. Pat. Nos. 4,723,129 and 4,740,796 is preferably used. The system disclosed therein can be applied to each of an on-demand type and a continuous type. Specifically, in the case of the on-demand type, it is effective because film boiling can be effected on a heat application surface of a recording head by producing thermal energy in an electrothermal energy converter disposed to face a seat or liquid passage in which a liquid (ink) is retained based on applying at least one driving signal for effecting an abrupt increase in temperature sufficient for nucleate boiling according to recording information, thereby forming bubbles in the liquid (ink) in one-to-one correspondence with the driving signal. The liquid (ink) is jetted through an jetting opening by the growth/contraction of the bubbles to form at least one droplet. If this driving signal is provided in the form of pulses, growth/contraction of bubbles can be suitably effected instantaneously, thereby achieving jetting of the liquid (ink) with improved response. The use of a pulse driving signal is therefore more preferable. Preferably, pulse driving signals such as those disclosed in U.S. Pat. Nos. 4,463,359 and 4,345,262 may be used. It is possible to further improve the recording performance by adopting conditions disclosed in U.S. Pat. Nos. 4,313,124 relating to the rate of increase in the temperature of the heat application surface.

The present invention also includes recording head arrangements in which heat application portions are disposed on bending regions as disclosed in U.S. Pat. Nos. 4,558,333 and 4,459,600, as well as arrangements based on a combination of jetting holes, liquid passages (linear liquid passages or perpendicular liquid passages) and electrothermal converters as disclosed in the above-mentioned specifications. In addition, the present invention is also effective when applied to an apparatus based on an arrangement, such as the one disclosed in Japanese Patent Laid-Open No. 59-123670, in which a common slit is provided for a jetting portion of a plurality of electrothermal converters, or an arrangement, such as the one disclosed in Japanese Patent Laid-Open No. 59-138461, in which an opening for absorbing pressure waves is formed so as to face a jetting portion. That is, according to the present invention, the reliability and the efficiency of recording can be improved irrespective of the construction of recording head.

Further, the present invention can be effectively applied to a full-line type recording head having a length corresponding to the maximum width of the recording medium which can be used for the recording apparatus. Such a recording head may be arranged to obtain the suitable length by using a combination of a plurality of heads or an integrally formed single recording head.

The present invention is effective with respect to any other types of recording heads, including the above-mentioned serial type, a recording head fixed to the main apparatus body, an interchangeable chip type recording head which can be electrically connected to the main apparatus body and to which an ink can be supplied from the main body when attached to the main body, and a cartridge type recording head on which an ink tank is integrally mounted.

It is preferable to add, as a recording apparatus component, a recovery means, auxiliary means for a preliminary operation for the recording head and so on, because it enables an improvement in the stability of the effects of the present invention. More specifically, these additional means are, for example, a means for capping the recording head, a means for cleaning the recording head, a pressurizing or absorbing means, and a preliminary heating means based on an electrothermal converter or any other type of heating element or a combination of these elements. Using a preliminary jetting mode separately from recording is also effective in performing recording with stability.

The kind of recording head or the number of recording heads to be mounted may be limited to one for single color ink or may be plural in correspondence with a plurality of inks differing in recording color or density. For example, the present invention is very effective when applied to an apparatus having a recording mode of using a multiplicity of different colors or full-color mode based on color mixing with one integrally formed recording head or a plurality of recording heads combined, as well as a mode of recording in a main color such as black.

In the description of the above-described embodiments, the ink is referred to as a liquid. However, the ink in accordance with the present invention may be an ink solidified at a temperature generally equal to or lower than room temperature and softened or liquefied at room temperature, or an ink liquefied when an operating recording signal is applied, since, in ink jet recording systems, the temperature of the ink is controlled in a range of 30 to 70° C. to set the viscosity of the ink to a stable jetting range. The present invention is also applicable with respect to other types of ink or other kinds of use. That is, an ink which is solidified under an ordinary condition may be used for the purpose of preventing the temperature of the ink from excessively increasing by the applied thermal energy based on using the applied energy as the energy for a phase change of the ink from a solid state to a liquid state or for the purpose of preventing evaporation of the ink. In either case, the ink is liquefied by the application of thermal energy according to the recording signal to be jetted in the liquefied state period. Also, an ink which is liquefied only when it receives thermal energy is controlled so as to start solidifying when it reaches the recording medium. Such an ink may be used in such a manner that it faces an electrothermal element while being retained in a liquid or solid state in a recessed portion or through holes of a porous seat, as disclosed in Japanese Patent Laid-Open No. 54-56847 or 60-71260. According to the present invention, the above-described film boiling system is most effective in using each of these inks.

The ink jet recording apparatus in accordance with the present invention may be an image output terminal of an information processing system such as a computer, a copier combined with a reader or the like, or a facsimile apparatus having transmitting and receiving functions.

As described above in detail, each of the ink cartridge and the ink jet recording apparatus in accordance with the present invention is composed of independently separable units detachably connected to each other.

What is claimed is:

1. An ink jet recording apparatus for recording on a recording medium using an ink jet recording head for recording by discharging ink, said apparatus comprising:

a carriage unit having a carriage for holding the ink jet recording head, a moving mechanism for moving said carriage and the ink jet recording head in a predetermined direction, and a frame for supporting said moving mechanism;

a conveying unit having a support member for holding said carriage unit and for forming a recording area with said carriage unit, and a conveying mechanism for introducing the recording medium to the recording area and for exhausting the recording medium from the recording area; and an ink supply unit having a recovery device for recovering an ink discharge function of the ink let recording head and a locking portion for locking to said carriage unit at a frame member supporting an ink storing portion for storing ink to be supplied to said ink jet recording head, whereby by connecting said frame of said carriage unit to said support member of said conveying unit, an introducing area is defined for introducing the recording medium to the recording area, and an exhausting area is defined for exhausting the recording medium from the recording area.

2. An ink Set recording apparatus according to claim 1, wherein said carriage holds a plurality of ink jet recording heads for discharging different inks.

3. An ink jet recording apparatus according to claim 1, wherein said recovery device comprises an ink path communicating with the recording head held on said carriage unit and a sealing section for disconnecting said ink path between said recovery unit and the recording head held on said carriage unit and sealing an end of said disconnected ink path.

4. An ink jet recording apparatus according to claim 1, wherein said carriage unit includes a mechanism for maintaining a predetermined distance between the ink jet recording head and a recording surface of the recording medium.

5. An ink jet recording apparatus according to claim 1, wherein said conveying unit includes a cassette for containing the recording medium and a roller member for conveying the recording medium.

6. An ink jet recording apparatus according to claim 1, wherein said carriage unit includes a belt member for moving said carriage in the predetermined direction and a drive motor for driving said belt member.

7. An ink jet recording apparatus according to claim 1, wherein the ink jet recording head comprises an electrothermal transducer for heating the ink to discharge the ink through the discharge opening.

8. An ink jet recording apparatus according to claim 1, wherein said carriage unit is locked to said conveying unit by engaging a pair of holes with threaded portions corresponding to said holes.

9. An ink jet recording apparatus for effecting recording on a recording medium by discharging ink through a discharge opening, said apparatus comprising:

a transport unit comprising transport means for transporting the recording medium and a chassis on which said transport means is mounted;

a recording unit comprising a mounting portion on which a recording head for discharging ink supplied from an ink containing portion to effect recording is mounted and a frame on which said mounting portion is mounted; and a recovery unit comprising a recovery device for restoring a function of discharging the ink through the discharge opening, wherein said recovery unit comprises a frame member on which said recovery device is mounted and mounted on said frame member are said ink containing portion and a locking portion for locking to said recording unit, and wherein said chassis of said transport unit and said frame member of said recovery unit are removably attached to said frame of said recording unit.

10. An ink jet recording apparatus according to claim 9, wherein the recording head comprises an ink jet recording head which comprises an electrothermal transducer for heating the ink to discharge the ink through the discharge opening.

11. An ink jet recording apparatus according to claim 9, wherein said recording unit is locked to said transport unit by engaging a pair of holes with threaded portions corresponding to said holes.

12. An ink jet recording apparatus according to claim 9, wherein said mounting portion holds a plurality of recording heads for discharging different inks.

13. An ink jet recording apparatus according to claim 9, wherein said recovery device comprises an ink path communicating with the recording head held on said mounting portion and a sealing section for disconnecting said ink path between said recovery unit and the recording head held on said mounting portion and sealing an end of said disconnected ink path.

14. An ink jet-recording apparatus according to claim 9, wherein said recording unit includes a mechanism for maintaining a predetermined distance between the recording head and a recording surface of the recording medium.

15. An ink jet recording apparatus according to claim 9, wherein said transport unit includes a cassette for containing the recording medium and a roller member for conveying the recording medium.

16. An ink jet recording apparatus according to claim 9, wherein said recording unit includes a belt member for moving said mounting portion in a predetermined direction and a drive motor for driving said belt member.

17. An ink jet recording apparatus for recording on a recording medium using an ink jet recording head for recording by discharging ink, said apparatus comprising:

a carriage unit having a carriage for holding the ink jet recording head, a moving mechanism for moving said carriage and the ink jet recording head in a predetermined direction, and a frame for supporting said moving mechanism;

a conveying unit having a support member for holding said carriage unit and for forming a recording area with said carriage unit, and a conveying mechanism for introducing the recording medium to the recording area and for exhausting the recording medium from the recording area; and an ink supply unit having a locking portion for locking to said carriage unit at a frame member supporting an ink storing portion for storing ink to be supplied to the ink jet recording head, wherein by connecting said frame of said carriage unit to said support member of said conveying unit, an introducing area is defined for introducing the recording medium to the recording area, and an exhausting area is defined for exhausting the recording medium from the recording area.

18. An ink jet recording apparatus according to claim 17, wherein said carriage holds a plurality of ink jet recording heads for discharging different inks.

19. An ink jet recording apparatus according to claim 17, wherein said carriage unit includes a mechanism for maintaining a predetermined distance between the ink jet recording head and a-recording surface of the recording medium.

20. An ink jet recording apparatus according to claim 17, wherein said conveying unit includes a cassette for containing the recording medium and a roller member for conveying the recording medium.

21. An ink jet recording apparatus according to claim 17, wherein said carriage unit includes a belt member for moving said carriage in the predetermined direction and a drive motor for driving said belt member.

22. An ink jet recording apparatus according to claim 17, wherein the ink jet recording head comprises an electrothermal transducer for heating the ink to discharge the ink through the discharge opening.

23. An ink jet recording apparatus according to claim 17, wherein said carriage unit is locked to said conveying unit by engaging a pair of holes with threaded portions corresponding to said holes.

24. An ink jet recording apparatus for recording on a recording medium using an ink jet recording head for recording by discharging ink, said apparatus comprising:

a carriage unit having a carriage for holding the ink jet recording head, a moving mechanism for moving said carriage and the ink jet recording head in a predetermined direction, and a frame for supporting said moving mechanism;

a conveying unit having a support member for holding said carriage unit and for forming a recording area with said carriage unit, and a conveying mechanism for introducing the recording medium to the recording area and for exhausting the recording medium from the recording area; and an ink supply unit having a locking portion for locking to said carriage unit at a frame member supporting an ink storing portion for storing ink to be supplied to the ink jet recording head, wherein said conveying unit and said frame member of said ink supply unit are removably attached to said carriage unit.

25. An ink jet recording apparatus according to claim 24, wherein said carriage holds a plurality of ink jet recording heads for discharging different inks.

26. An ink jet recording apparatus according to claim 24, wherein said carriage unit includes a mechanism for maintaining a predetermined distance between the ink jet recording head and a recording surface of the recording medium.

27. An ink jet recording apparatus according to claim 24, wherein said conveying unit includes a cassette for containing the recording medium and a roller member for conveying the recording medium.

28. An ink jet recording apparatus according to claim 24, wherein said carriage unit includes a belt member for moving said carriage in the predetermined direction and a drive motor for driving said belt member.

29. An ink jet recording apparatus according to claim 24, wherein the ink jet recording head comprises an electrothermal transducer for heating the ink to discharge the ink through the discharge opening.

30. An ink jet recording apparatus according to claim 24, wherein said carriage unit is locked to said conveying unit by engaging a pair of holes with threaded portions corresponding to said holes.

* * * * *

UNITED STATES PATENT AND TRADEMARK OFFICE

CERTIFICATE OF CORRECTION

PATENT NO. : 5,907,343 Page 1 of 2

DATED : May 25, 1999

INVENTOR(S) : TAKEMURA ET AL.

It is certified that error appears in the above-identified patent and that said Letters Patent is hereby corrected as shown below:

On the title page, item:

[56] References Cited:

FOREIGN PATENT DOCUMENTS, "8-206658" should read --60-206658--.

COLUMN 1:

Line 64, "flow" should read --flows--.

COLUMN 7:

Line 38, "of" should be deleted.

COLUMN 12:

Line 41, "377" should read --337--.

COLUMN 13:

Line 33, "Inc," should read --Inc.,--.

Line 50, "an" should read --a--.

COLUMN 15:

Line 4, "state period." should read --state.--.

Line 40, "let" should read --jet--.

Line 50, "Set" should read --jet--.

UNITED STATES PATENT AND TRADEMARK OFFICE

CERTIFICATE OF CORRECTION

PATENT NO. : 5,907,343 Page 2 of 2

DATED : May 25, 1999

INVENTOR(S) : TAKEMURA ET AL.

It is certified that error appears in the above-identified patent and that said Letters Patent is hereby corrected as shown below:

COLUMN 16:

Line 53, "jet-recording" should read --jet recording--.

COLUMN 17,

Line 28, "a-recording" should read --a recording--.

Signed and Sealed this

Twenty-eighth Day of December, 1999

*Attest:*

Q. TODD DICKINSON

*Attesting Officer*

*Acting Commissioner of Patents and Trademarks*